US009091126B2

(12) United States Patent
Thiessen et al.

(10) Patent No.: US 9,091,126 B2
(45) Date of Patent: Jul. 28, 2015

(54) MOBILE DRILLING RIG WITH TELESCOPING SUBSTRUCTURE BOXES

(71) Applicant: National Oilwell Varco, L.P., Houston, TX (US)

(72) Inventors: Jay John Thiessen, Edmonton (CA); Kameron Wayne Konduc, Edmonton (CA); Donald Leonard Burlet, Edmonton (CA)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 13/863,680

(22) Filed: Apr. 16, 2013

(65) Prior Publication Data

US 2013/0269268 A1 Oct. 17, 2013

Related U.S. Application Data

(60) Provisional application No. 61/625,505, filed on Apr. 17, 2012.

(51) Int. Cl.
*E04H 14/00* (2006.01)
*E21B 15/00* (2006.01)
*E21B 7/02* (2006.01)

(52) U.S. Cl.
CPC ..... *E21B 15/00* (2013.01); *E21B 7/023* (2013.01); *E21B 15/003* (2013.01)

(58) Field of Classification Search
CPC ..... E21B 15/00; E21B 7/02; E21B 7/023; E21B 15/003; E21B 15/006; E04H 12/34; E04H 12/18; E04H 12/182
USPC ..... 52/111, 114, 117, 118, 632, 651.05; 173/184, 185, 186
See application file for complete search history.

(56) References Cited

U.S. PATENT DOCUMENTS 2,617,500 A * 11/1952 Cardwell et al. ..... 52/115
2,695,081 A * 11/1954 Woolslayer et al. ..... 52/119

(Continued)

FOREIGN PATENT DOCUMENTS

EP 1 980 710 A2 10/2008
WO WO 2004/035985 4/2004 ..... E21B 15/00

(Continued)

OTHER PUBLICATIONS

Partial International Search (Annex to Form PCT/ISA/206) dated Apr. 3, 2014 for International Application No. PCT/ US2013/036860, 4 pages.

(Continued)

*Primary Examiner* — Robert Canfield
*Assistant Examiner* — Babajide Demuren
(74) *Attorney, Agent, or Firm* — Amerson Law Firm, PLLC

(57) ABSTRACT

Disclosed herein is a telescoping substructure of a drilling rig that includes first and second telescoping substructure boxes. The first and second telescoping substructure boxes each include, among other things, a lower substructure box and an upper substructure box that is adapted to be telescopically raised and lowered relative to the lower substructure box. Furthermore, each telescoping substructure box also includes raising means for telescopically raising and lowering the upper substructure box relative to the lower substructure box between a collapsed configuration for transportation and a raised configuration for drilling operations, wherein each of the first and second telescoping substructure boxes are adapted to facilitate movement of the telescoping substructure in at least one of a lateral direction and a longitudinal direction over wellhead equipment positioned above a wellbore location when the upper substructure boxes are in the raised configuration.

25 Claims, 29 Drawing Sheets

(56) References Cited

U.S. PATENT DOCUMENTS

| | | | | |
|---|---|---|---|---|
| 2,840,198 | A | 6/1958 | Woolslayer et al. | |
| 2,887,191 | A * | 5/1959 | Lovell | 52/115 |
| 3,161,259 | A | 12/1964 | Wilson | |
| 3,486,737 | A | 12/1969 | Campbell | 254/106 |
| 3,807,109 | A * | 4/1974 | Jenkins et al. | 52/120 |
| 3,922,825 | A * | 12/1975 | Eddy et al. | 52/116 |
| 3,942,593 | A * | 3/1976 | Reeve et al. | 173/186 |
| 4,040,524 | A | 8/1977 | Lamb et al. | 414/22.52 |
| 4,108,255 | A | 8/1978 | Smith | 175/9 |
| 4,208,158 | A | 6/1980 | Davies et al. | 414/22 |
| 4,569,168 | A * | 2/1986 | McGovney et al. | 52/122.1 |
| 4,587,778 | A * | 5/1986 | Woolslayer et al. | 52/116 |
| 4,616,454 | A | 10/1986 | Ballachey et al. | 52/115 |
| 4,744,710 | A | 5/1988 | Reed | 414/22 |
| 4,819,730 | A | 4/1989 | Williford et al. | 166/355 |
| 4,899,832 | A | 2/1990 | Bierscheid, Jr. | 173/23 |
| 5,107,940 | A | 4/1992 | Berry | 175/85 |
| 5,492,346 | A | 2/1996 | Suksumake | 405/201 |
| 5,570,749 | A | 11/1996 | Reed | 175/66 |
| 5,921,336 | A | 7/1999 | Reed | |
| 6,047,781 | A | 4/2000 | Scott et al. | 175/5 |
| 6,056,071 | A | 5/2000 | Scott et al. | 175/5 |
| 6,068,069 | A | 5/2000 | Scott et al. | 175/5 |
| 6,085,851 | A | 7/2000 | Scott et al. | 175/7 |
| 6,158,516 | A | 12/2000 | Smith et al. | 166/385 |
| 6,161,358 | A | 12/2000 | Mochizuki et al. | 52/651.05 |
| 6,203,247 | B1 | 3/2001 | Schellstede et al. | 405/196 |
| 6,343,892 | B1 | 2/2002 | Kristiansen | 405/195.1 |
| 6,443,240 | B1 | 9/2002 | Scott | 175/7 |
| 6,634,436 | B1 | 10/2003 | Desai | |
| 6,766,860 | B2 | 7/2004 | Archibald et al. | 166/341 |
| 6,860,337 | B1 * | 3/2005 | Orr et al. | 173/28 |
| 6,932,553 | B1 | 8/2005 | Roodenberg et al. | 414/22.51 |
| 6,968,905 | B2 | 11/2005 | Adnan et al. | 166/384 |
| 6,973,979 | B2 | 12/2005 | Carriere et al. | 175/203 |
| 6,994,171 | B2 * | 2/2006 | Orr et al. | 173/28 |
| 7,320,374 | B2 | 1/2008 | Folk et al. | 175/220 |
| 7,377,335 | B2 | 5/2008 | Jones et al. | 175/57 |
| 7,401,656 | B2 | 7/2008 | Wood et al. | 166/384 |
| 7,413,393 | B1 * | 8/2008 | Barnes | 414/373 |
| 7,765,749 | B2 * | 8/2010 | Palidis | 52/112 |
| 7,828,087 | B2 * | 11/2010 | Vora | 175/220 |
| 8,181,697 | B2 | 5/2012 | Springett et al. | 166/52 |
| 8,181,698 | B2 | 5/2012 | Springett et al. | 166/52 |
| 2002/0074125 | A1 | 6/2002 | Fikes et al. | 166/352 |
| 2003/0098150 | A1 | 5/2003 | Andreychuk | 166/77.2 |
| 2003/0172599 | A1 * | 9/2003 | Frink | 52/116 |
| 2004/0200641 | A1 | 10/2004 | Jones et al. | 175/57 |
| 2004/0211572 | A1 * | 10/2004 | Orr et al. | 173/1 |
| 2004/0211598 | A1 * | 10/2004 | Palidis | 175/162 |
| 2004/0240973 | A1 * | 12/2004 | Andrews et al. | 414/332 |
| 2005/0161240 | A1 | 7/2005 | Orr et al. | |
| 2005/0193645 | A1 * | 9/2005 | Barnes | 52/120 |
| 2007/0193749 | A1 * | 8/2007 | Folk | 166/379 |
| 2007/0251725 | A1 | 11/2007 | Banks | 175/5 |
| 2008/0023228 | A1 | 1/2008 | Stevens | 175/57 |
| 2008/0251267 | A1 * | 10/2008 | Cicognani | 173/1 |
| 2009/0000218 | A1 * | 1/2009 | Lee et al. | 52/123.1 |
| 2009/0025937 | A1 | 1/2009 | Robinson et al. | 166/351 |
| 2009/0218139 | A1 * | 9/2009 | Donnally et al. | 175/57 |
| 2009/0218144 | A1 * | 9/2009 | Donnally et al. | 175/162 |
| 2009/0321135 | A1 * | 12/2009 | Vora | 175/57 |
| 2011/0072737 | A1 * | 3/2011 | Wasterval | 52/115 |
| 2012/0047820 | A1 * | 3/2012 | Donnally et al. | 52/123.1 |
| 2012/0066999 | A1 | 3/2012 | Donnaly et al. | |
| 2012/0138327 | A1 * | 6/2012 | Sorokan et al. | 173/189 |
| 2012/0167485 | A1 * | 7/2012 | Trevithick et al. | 52/112 |

FOREIGN PATENT DOCUMENTS

| | | | |
|---|---|---|---|
| WO | WO2008/103156 | 8/2008 | E21B 19/16 |
| WO | WO 2008/118914 | 10/2008 | E21B 7/12 |
| WO | 2009/138802 | 11/2009 | |
| WO | WO2010/019858 | 2/2010 | E21B 15/00 |

OTHER PUBLICATIONS

PCT/US2009/053849 International Search Report (Dec. 2, 2009).
Office Action from parent U.S. Appl. No. 12/316,801 dated Feb. 24, 2011.
PCT Search Report and Written Opinion from PCT/US2010/058835 dated Feb. 21, 2012.
PCT International Search Report and Written Opinion dated Nov. 21, 2014 for International Application No. PCT/US2013/036860.

* cited by examiner

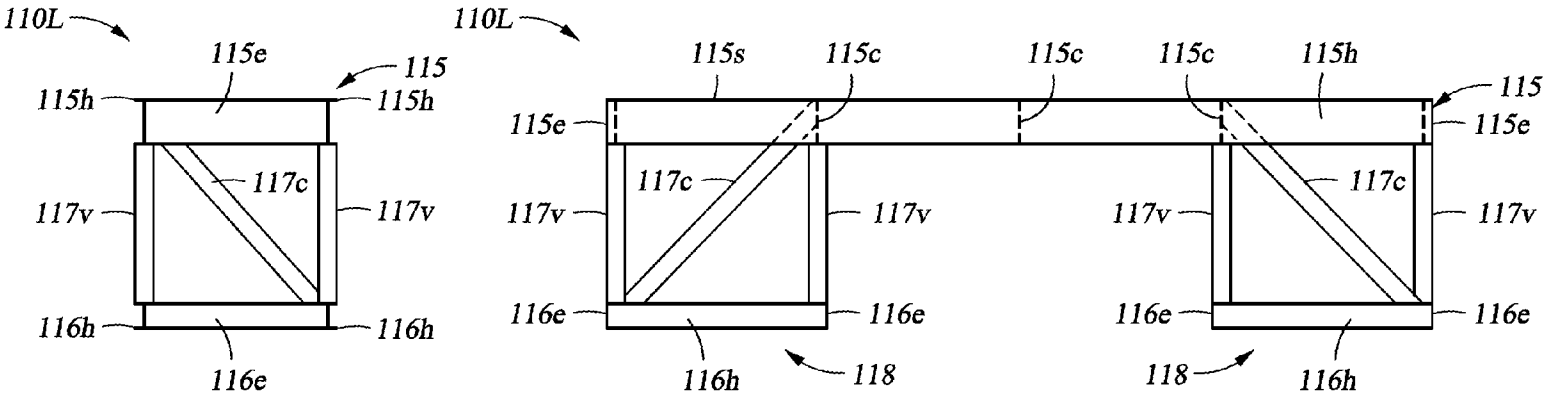
Fig. 2D
Fig. 2E
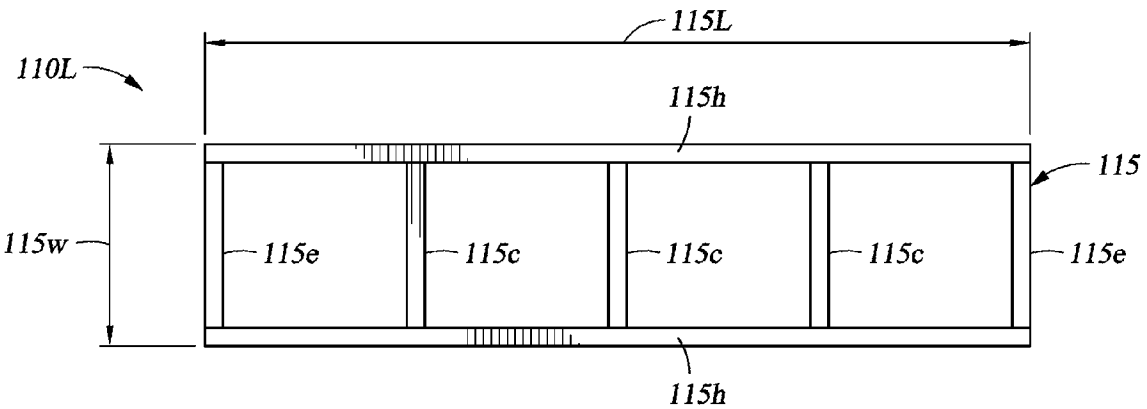
Fig. 2F

MOBILE DRILLING RIG WITH TELESCOPING SUBSTRUCTURE BOXES

BACKGROUND

1. Field of the Disclosure

The present subject matter is generally directed to mobile drilling rig assemblies, and in particular, to a substructure of a mobile drilling rig having telescoping substructure boxes to facilitate drilling rig assembly and erection.

2. Description of the Related Art

In many land-based oil and gas drilling operations, drilling rigs are delivered to an oilfield drilling site by transporting the various components of the drilling rig over roads and/or highways. Typically, the various drilling rig components are transported to a drilling site on one or more truck/trailer combinations, the number of which may depend on the size, weight, and complexity of the rig. Once at the drilling site, the drilling rig components are then assembled, and the drilling rig assembly is raised to an operating position so as to perform drilling operations. After the completion of drilling operations, the mobile drilling rig is then lowered, disassembled, loaded back onto truck/trailer combinations, and transported to a different oilfield drilling site for new drilling operations. Accordingly, the ease with which the various drilling rig components can be transported, assembled and disassembled, and raised and lowered can be a substantial factor in the drilling rig design, as well as the rig's overall operational capabilities and cost effectiveness.

As drilling rig technologies have progressed, the size and weight of mobile drilling rigs has significantly increased so as to meet the higher drilling load capabilities that are oftentimes required to drill deeper wells, particularly in more mature oilfield formations. For example, it is not uncommon for many land-based mobile drilling rigs to have a 1500-2000 HP capability, with hook load capacities of 1 million pounds or greater. Additionally, there are some even larger 3000 HP mobile drilling rigs in operation, with hook and/or rotary load capacities exceeding 1.5 million pounds.

However, as the capacity—and the overall size and weight—of mobile drilling rigs increases, the size and weight of many of the various components of the rig also proportionately increase, a situation that can sometimes contribute to an overall reduction in at least some of the "mobility" characteristics of the rig. For example, a typical drawworks for a 2000 HP mobile rig may weigh in the range of 80-100 thousand pounds, or even more. Furthermore, individual sections of a drilling rig mast may be 30-40 feet or more in length, and may weigh 20-80 thousand pounds each. In many cases, such large and heavy components require the use of a suitably sized crane so as to lift and position the various drilling components during rig assembly. Accordingly, while each of the various larger rig components may be "transportable" over roads and/or highways from one oilfield drilling site to another, the overall logistical considerations for using at least some higher capacity mobile drilling rigs, e.g., 1500 HP and greater, may need to include having a crane present at a given drilling site prior to the commencement of drilling operations in order to facilitate initial rig assembly. Furthermore, a crane may also need to be present after the completion of drilling operations so as to facilitate rig disassembly for transportation to other oilfield drilling sites. As may be appreciated, the requirement that a crane be used during these assembly/disassembly stages can have a significant impact on the overall cost of the drilling operation, as well as the amount of time that may be needed to perform the operations.

In some applications, drilling operations at a given oilfield drilling site may involve drilling a plurality of relatively closely spaced wellbores, sometimes referred to as "pad" drilling. In pad drilling, the distance between adjacent wellbores may be as little as 20-30 feet, or even less, and are oftentimes arranged in a two-dimensional grid pattern, such that rows and columns of wellbores are disposed along lines that run substantially parallel to an x-axis and a y-axis, respectively. In such pad drilling applications, after drilling operations have been completed at one wellbore, it is necessary to move the drilling rig to an adjacent wellbore, which can be quite costly and time consuming when a crane is required to disassemble, lift, and move the various drilling rig components to the next wellbore location before drilling operations can commence. Furthermore, even when the fully assembled and erected drilling rig is designed to be moved from wellbore to wellbore via wheeled trailers or dollies, such moving devices are generally only capable of being moved substantially along a single axis, e.g., along an x-axis or along a y-axis. Accordingly, while it may be feasible to trailer such a mobile drilling rig in an axial direction between closely-spaced adjacent wellbores that are disposed along the same column or row of wellbores making up the grid pattern at a given pad drilling site, it is generally not possible to move the mobile drilling rig laterally or longitudinally, e.g., from row to row or from column to column, when using conventional wheeled trailers or dollies.

Accordingly, there is a need to develop and implement new designs and methods for facilitating the assembly of modern mobile drilling rigs having higher operating capacities without relying on the use of a crane to facilitate the assembly and/or disassembly the rig. Furthermore, there is also a need to facilitate the movement of fully assembled and erected mobile drilling rigs between closely-spaced adjacent wellbores during pad drilling operations. The following disclosure is directed to the design and use of mobile drilling rigs that address, or at least mitigate, at least some of the problems outlined above.

SUMMARY OF THE DISCLOSURE

The following presents a simplified summary of the present disclosure in order to provide a basic understanding of some aspects disclosed herein. This summary is not an exhaustive overview of the disclosure, nor is it intended to identify key or critical elements of the subject matter disclosed here. Its sole purpose is to present some concepts in a simplified form as a prelude to the more detailed description that is discussed later.

Generally, the subject matter disclosed herein relates to various aspects of a telescoping substructure of a mobile drilling rig that can be collapsed for transportation over highways and/or roads to an oilfield drilling site, and which can also be telescoped, i.e., raised or lowered, as necessary to facilitate assembly of the mobile drilling rig without the use of traditional stand-alone cranes. Furthermore, the telescoping substructure of the present disclosure may be used in conjunction with a mast positioning apparatus during rig assembly to facilitate the positioning of a drilling rig mast above the drilling floor of the mobile drilling rig, and the proper alignment of the drilling rig mast connections with the mast support shoes on the telescoping substructure without the use of a crane. Moreover, substructure raising means and rig moving means may be used to facilitate skid movement of the fully assembled and erected mobile drilling rig between adjacent wellbore locations during pad drilling operations, thereby avoiding the use of heavy lift cranes for disassembly of the rig prior to rig movement.

In one exemplary embodiment, a telescoping substructure of a drilling rig is disclosed that includes first and second telescoping substructure boxes. The first and second telescoping substructure boxes each include, among other things, a lower substructure box and an upper substructure box that is adapted to be telescopically raised and lowered relative to the lower substructure box. Furthermore, each telescoping substructure box also includes raising means for telescopically raising and lowering the upper substructure box relative to the lower substructure box between a collapsed configuration for transportation and a raised configuration for drilling operations, wherein each of the first and second telescoping substructure boxes are adapted to facilitate movement of the telescoping substructure in at least one of a lateral direction and a longitudinal direction over wellhead equipment positioned above a wellbore location when the upper substructure boxes are in the raised configuration.

Also disclosed herein is an illustrative method that includes, among other things, positioning a first telescoping substructure box adjacent to and laterally spaced apart from a second telescoping substructure box, the first and second telescoping substructure boxes each having an upper substructure box, a lower substructure box, and raising means for telescopically raising and lowering the respective first and second telescoping substructure boxes. The disclosed method further includes telescopically raising the laterally spaced apart first and second telescoping substructure boxes to a raised configuration for drilling operations by telescopically raising, with the raising means, the upper substructure boxes relative to the respective lower substructure boxes, and performing drilling operations with a drilling rig comprising the first and second telescoping substructure boxes on a first wellbore location positioned between the laterally spaced apart first and second telescoping substructure boxes. Additionally, the disclosed method also includes moving the drilling rig from the first wellbore location to a second wellbore location while the first and second telescoping substructure boxes are in the raised configuration and while pressure-retaining equipment is positioned above at least one of the first and second wellbore locations.

In another illustrative embodiment, a drilling rig mast erection system is disclosed that includes, among other things, a mast support shoe fixedly attached to a drilling rig substructure, the mast support shoe having a first pinned connection. Furthermore, the drilling rig mast erection system also includes a bottom mast section of a drilling rig mast, the bottom mast section having a second pinned connection that is adapted to be pivotably connected to the first pinned connection of the mast support shoe. Moreover, the disclosed mast erection system includes a mast positioning apparatus that is adapted to pivotably position the bottom mast section so that the second pinned connection of the bottom mast section is positioned adjacent to the first pinned connection of the mast support shoe.

Yet another exemplary embodiment of the present disclosure is a method for erecting a drilling rig mast that includes, among other things, pivotably connecting a first end of bottom mast support spreader to a bottom mast section of the drilling rig mast and pivotably rotating the bottom mast support spreader about a second end of the bottom mast support spreader to pivotably position a first pinned connection of the bottom mast section adjacent to a second pinned connection of a mast support shoe. The disclosed method further includes pivotably connecting the first pinned connection of the bottom mast section to the second pinned connection of the mast support shoe.

BRIEF DESCRIPTION OF THE DRAWINGS

The disclosure may be understood by reference to the following description taken in conjunction with the accompanying drawings, in which like reference numerals identify like elements, and in which:

FIGS. 2D-2F are end elevation, side elevation, and plan views, respectively, of an illustrative lower telescoping substructure box according to the present disclosure;

Figure 1A:
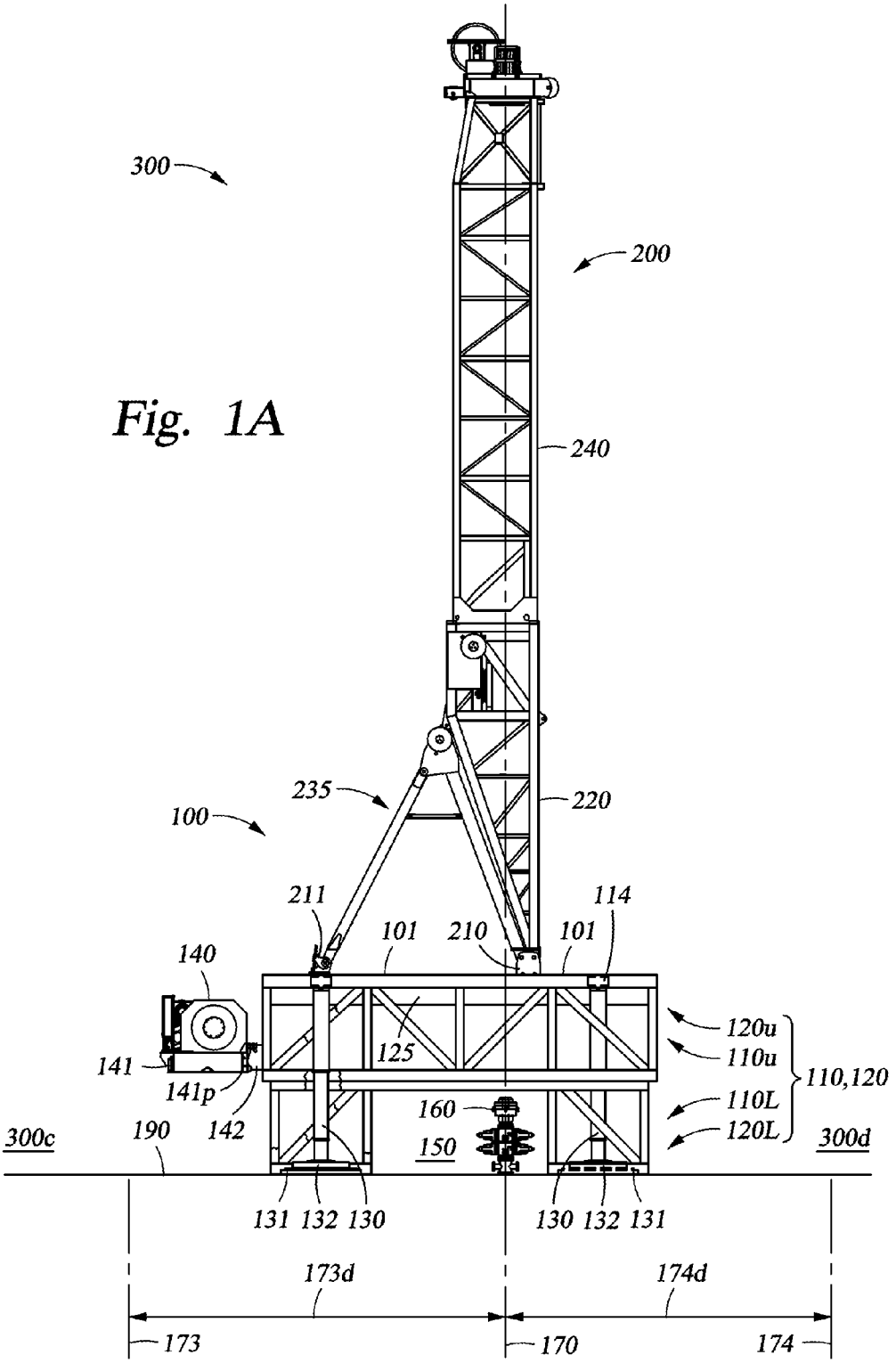
FIGS. 1A and 1B are side and end elevation views, respectively, of a mobile drilling rig having a telescoping substructure in accordance with one illustrative embodiment of the present disclosure.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Various illustrative embodiments of the present subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various systems, structures and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Generally, the subject matter disclosed herein is directed to mobile drilling rig assemblies having telescoping substructure boxes, which may be used to facilitate the assembly and installation of large and/or heavy drilling rig components, such as a drilling rig mast, rig drawworks, driller's cabin, and the like, without relying on the use of a stand-alone crane to lift and/or position the various rig components. Furthermore, a mast positioning apparatus is disclosed herein that may be used to position the drilling rig mast adjacent to the mast support shoes on the drilling floor while the telescoping substructure boxes are in a collapsed configuration, thereby allowing the mast to be pivotably attached to mast support shoes in preparation for mast erection. Also disclosed are substructure raising apparatuses that may be used to telescope, i.e., raise and lower, the telescoping substructure boxes during drilling rig assembly, as well as lift the assembled mobile drilling rig for skid movement between adjacent wellbore locations during pad drilling operations.

Figure 1B:
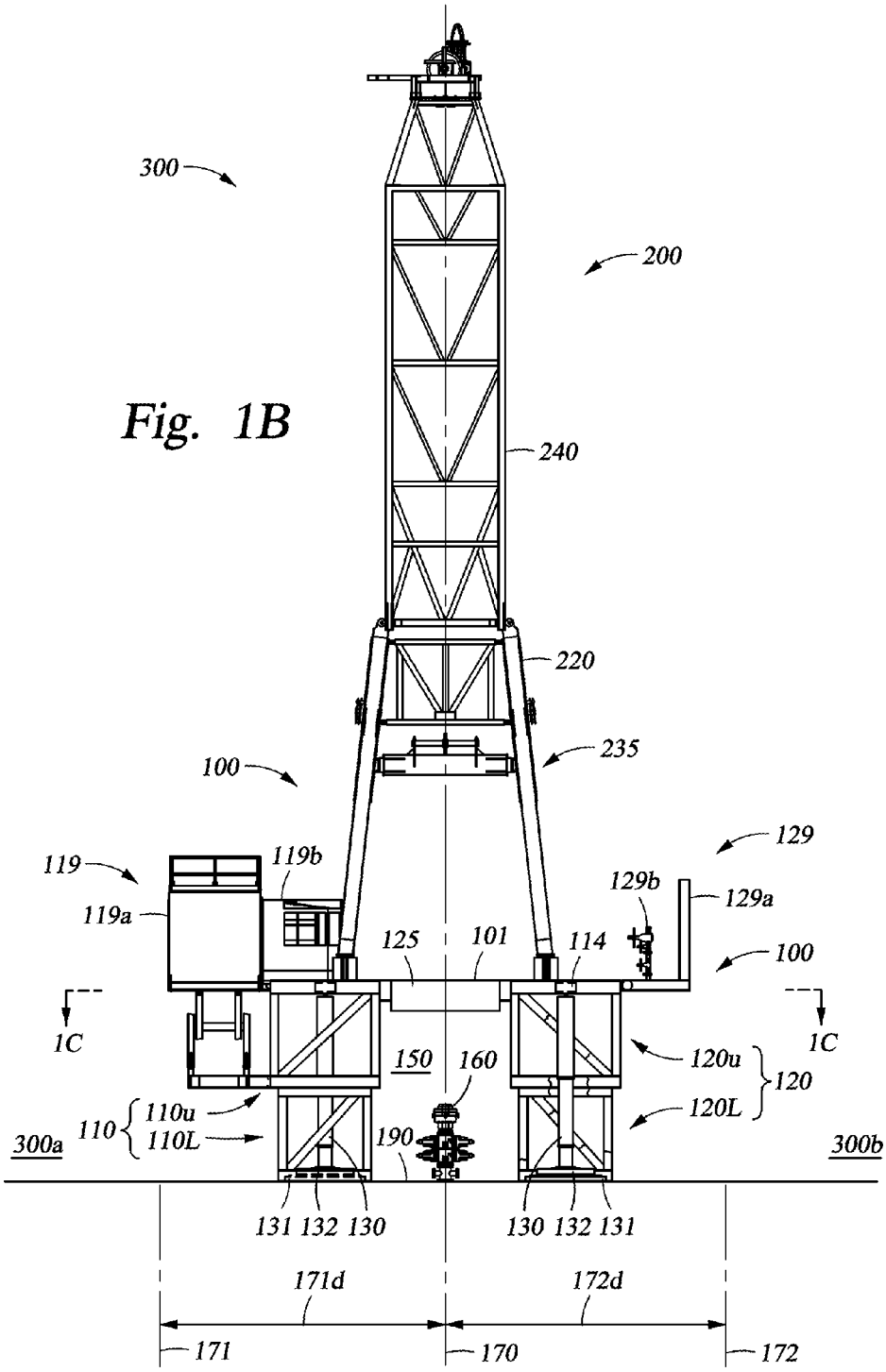

FIGS. 1A and 1B are side and end elevation views, respectively, of an illustrative mobile drilling rig 300 accordingly to the present disclosure that generally includes a driller's side 300*a*, an off-driller's side 300*b*, a drawworks side 300*c*, and a setback side 300*d*. More specifically, FIG. 1A is an elevation view of the rig 300 when viewed from the driller's side 300*a* of the rig 300, and FIG. 1B is an elevation view of the rig 300 when viewed from the setback side 300*d*, or front side, of the rig 300. As shown in the illustrative embodiment depicted in FIGS. 1A and 1B, the mobile drilling rig 300 may include, among other things, a telescoping substructure 100 and a drilling rig mast 200. In certain illustrative embodiments, the telescoping substructure 100 may include a driller's side 300*a* telescoping substructure box 110 that is made up of an upper substructure box 110*u* and a lower substructure box 110L, an off-driller's side 300*b* telescoping substructure box 120 that also includes upper and lower substructure boxes 120*u*, 120L, and a substructure center floor section 125 positioned between and supported by the upper substructure boxes 110*u* and 120*u*. Generally, each upper substructure box 110*u*, 120*u* is operatively coupled to and engages with its respective lower substructure box 110L, 120L in such a manner so as to allow the upper substructure boxes 110*u*, 120*u* to be raised and/or lowered relative to the lower substructure boxes 110L, 120L when the telescoping substructure boxes 110, 120 are "telescoped" into different positions, e.g., for rig transportation to a drilling site, drilling operations at the drilling site, and/or rig movement around the drilling site, as will be further described below. Additionally, the upper surfaces of the telescoping substructure 100, e.g., the upper surfaces of the telescoping substructure boxes 110, 120 and the substructure center floor section 125 may form a drilling floor 101 where personnel, as well as materials and equipment, may be present during the various drilling rig operations.

As shown in FIGS. 1A and 1B, a drilling rig cellar area 150 is located between the telescoping substructure boxes 110, 120 and below the substructure center floor section 125. Pressure-retaining wellhead equipment 160, such as a blowout preventer apparatus and the like, may be positioned in the cellar area 150 above a wellbore location 170, where drilling operations may be performed so as to drill and advance a wellbore below the surface of the ground 190. Furthermore, when the mobile drilling rig 300 is utilized at an oilfield drilling site where pad drilling operations are performed, additional wellbore locations may be located closely adjacent to the wellbore location 170. For example, a driller's side 300*a* wellbore location 171 and an off-driller's side 300*b* wellbore location 172 may be laterally positioned on either side of the wellbore location 170, as shown in FIG. 1B. Similarly, a drawworks side 300*c* wellbore location 173 and a setback side 300*d* wellbore location 174 may be longitudinally positioned on either side of the wellbore location 170, as shown in FIG. 1A Depending on the specific grid pattern layout of the wellbore locations for the pad drilling site in question, each of the wellbore locations 171-174 may be located at respective distances 171*d*-174*d* away from the wellbore location 170, which may be as close as approximately 20 feet or less, or as far away as approximately 100 feet or more. It should be appreciated, however, that other spacing distances may also be used in pad drilling applications. Moreover, it should also be appreciated that the spacing between the wellbore location 170 and each of the adjacent wellbore locations 171-174 need not be uniform, e.g., each of the distances 171*d*-174*d* may be different.

In at least some exemplary embodiments of the present disclosure, a drawworks 140 may be attached to the upper substructure boxes 110*u*, 120*u* of the telescoping substructure 100, as shown in FIG. 1A. For example, the drawworks 140 may be supported by a drawworks skid 141, which may include appropriately designed connections 141*p* that are adapted to removably attach the drawworks skid 141 and drawworks 140 to support clips 142 on each of the upper substructure boxes 110*u*, 120*u*.

In certain embodiments, a driller's side 300*a* ancillary structure 119 may be removably attached to the driller's side 300*a* telescoping substructure box 110 as shown in FIG. 1B, which may include, for example, a driller's cabin 119*a*, and control cabin 119*b*, and the like. In other embodiments, an off-driller's side 300*b* ancillary structure 129 may also be removably attached to the off-driller's side 300*b* telescoping substructure box 120, which may include, among other things, a wind wall 129*a*, standpipe manifold 129*b*, and the like. It should be understood, however, that the various components of the driller's side 300*a* and off-driller's side 300*b* ancillary structures 119 and 129 described above are illustrative only, as other types of ancillary structures may be used on the mobile drilling rig 300, or the drilling rig 300 may be used without any such ancillary structures.

As shown in the illustrative embodiment depicted in FIGS. 1A and 1B, the telescoping substructure 100 may also include means for telescopically raising raise and/or lowering the upper substructure boxes 110*u* and/or 120*u* relative to a respective lower substructure box 110L and/or 120L—i.e., means for "telescoping" the substructure boxes 110 and 120 of the telescoping substructure 100—which in some cases may hereinafter be referred to as "substructure raising apparatuses" 130, for simplicity. Depending on the specific assembly and erection requirements of the mobile drilling rig 300, the substructure raising apparatuses 130 may be adapted to telescopically raise and lower the substructure boxes 110, 120 as may be required for a particular rig assembly, operating, or disassembly stage. For example, the substructure raising apparatuses 130 may be adapted to generate a force of sufficient magnitude to raise the upper substructure boxes 110*u*, 120*u* above the lower substructure boxes 110L, 120L when the mobile drilling rig 300 is in a fully assembled condition, e.g., including all equipment and structures such as the drilling rig mast 200, drawworks 140, ancillary structures 119 and/or 129, etc. Furthermore, in at least some embodiments, the means for raising and lowering the telescoping substructure boxes 110 and 120 may also be used as means for lifting and lowering the substructure boxes 110 and 120 relative to the ground 190, and/or lifting and lowering the fully assembled mobile drilling rig 300 relative to the ground 190, depending on the specific rig assembly, operating, or disassembly stage.

For example, the means for raising and lowering the telescoping substructure boxes 110, 120, such as the substructure raising apparatuses 130 shown in FIGS. 1A and 1B, may be used to lift and/or lower the telescoping substructure boxes 110, 120 relative to the ground 190 during an unloading stage after the fully collapsed substructure boxes 110, 120 have been transported to an oilfield drilling site, as will be further described with respect to FIGS. 3A-3C below, and/or to reload the fully collapsed substructure boxes 110, 120 for movement to another oilfield drilling site after rig disassembly. Additionally, in those embodiments wherein pad drilling operations are contemplated, the means for raising and lower the telescoping substructure 100 may also be appropriately sized so that the means can be used for lifting and lowering the fully assembled mobile drilling rig 300 relative to the ground 190 so that the rig 300 can be skidded from, for example, the wellbore location 170 to an adjacent wellbore location 171-174, as will also be further discussed with respect to FIGS. 7A and 7B below.

In at least some embodiments, each of the substructure raising apparatuses 130 may be, for example, a telescoping hydraulic and/or pneumatic cylinders, screw and/or gear mechanisms, chain and sprocket arrangements, or cable and pulley/roller arrangements and the like. See, for example, the substructure raising apparatuses 130 shown in FIGS. 1A and 1B. Furthermore, each substructure raising apparatus 130 (or apparatuses 130) may be attached at an upper end thereof to an appropriately designed structural support member 114 (or members 114) on the respective upper substructure boxes 110*u*, 120*u*. The substructure raising apparatuses 130 may also have attached at a lower end thereof a respective bearing plate or skid foot 131, which is typically used to transfer the weight of the telescoping substructure 100, or the fully assembled mobile drilling rig 300, to the ground 190 during substructure telescoping (raising and/or lowering) operations. Additionally, in those illustrative embodiments of the mobile drilling rig 300 that are adapted to perform pad drilling operations, means for moving the fully assembled rig 300 may be operatively coupled to the telescoping substructure 100. For example, in at least some exemplary embodiments, the means for moving the fully assembled mobile drilling rig may include a skid foot movement apparatus 132 that may be positioned between and operatively coupled to each substructure raising apparatus 130 and its respective skid foot 131 so as to facilitate skid movement of the fully assembled rig 300 between adjacent wellbore locations 170 and 171-174, as will be further described with respect to FIGS. 7C-7H below.

Figure 1C:
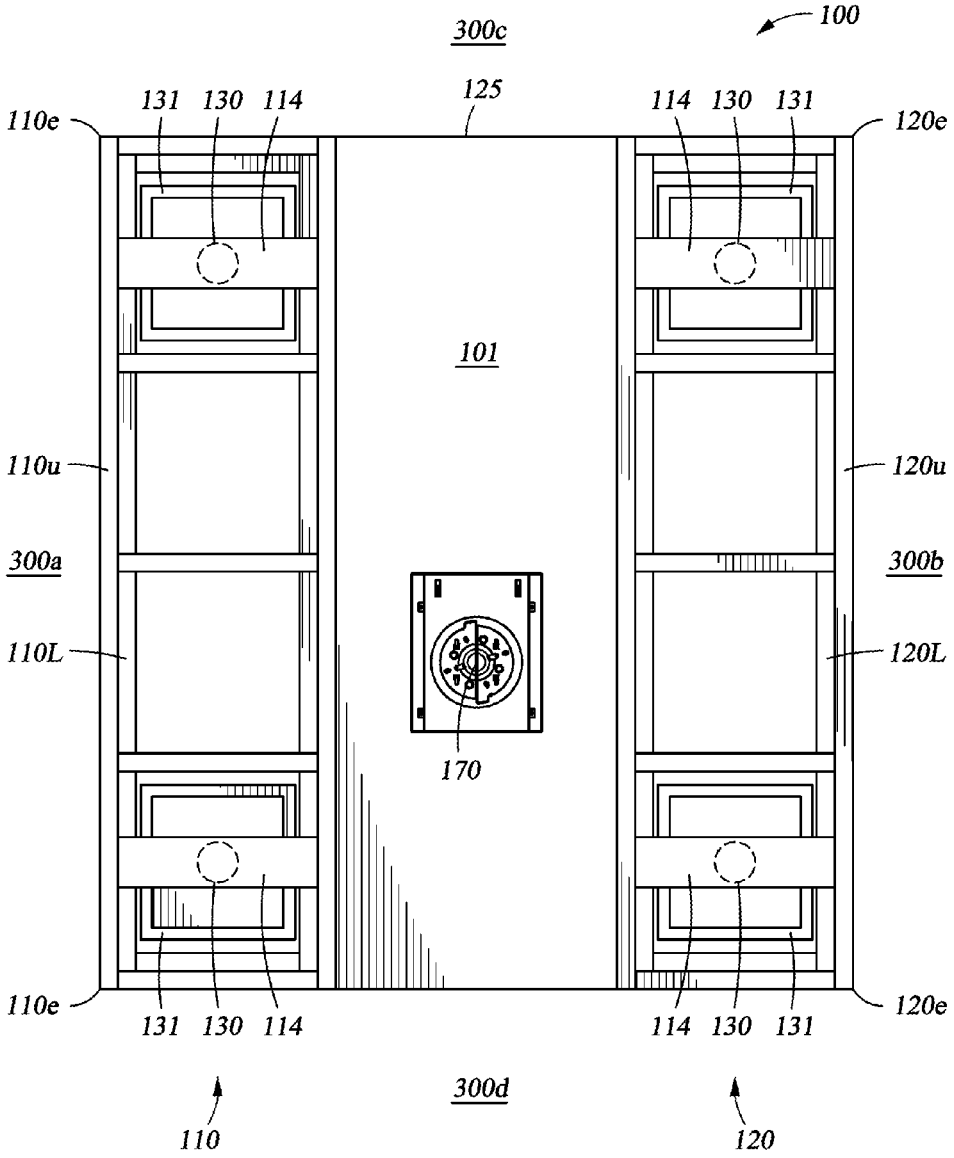
FIG. 1C is a plan view of the illustrative telescoping substructure of FIGS. 1A and 1B.

FIG. 1C is a plan view of the illustrative telescoping substructure 100 taken along the view line "1C-1C" of FIG. 1B, wherein some elements of the mobile drilling rig 300, such as the drilling rig mast 200 and drilling floor 101 above each of the telescoping substructure boxes 110, 120 have been removed for clarity. In some illustrative embodiments, each of the plurality of substructure raising apparatuses 130 may be positioned near a respective corner of the telescoping substructure 100, i.e., such that one substructure raising apparatus 130 is proximate each end 110*e* and 120*e* of the respective telescoping substructure boxes 110 and 120. Furthermore, in certain embodiments, each substructure raising apparatuses 130 may be substantially centered below a respective structural support member 114, as shown in FIG. 1C. Accordingly, each telescoping substructure box 110, 120 may be telescoped, i.e., raised and/or lowered, by actuating the pair of substructure raising apparatuses 130 located at the respective ends 110*e*, 120*e*.

As noted above, in the exemplary mobile drilling rig 300 illustrated in FIGS. 1A-1C, a single substructure raising apparatus 130 is positioned near each corner of the telescoping substructure 100. However, it should be appreciated that, in light of the general concepts described above, more than one substructure raising apparatus 130 may be used at each respective corner location. For example, in certain embodiments, it is well within the scope of the present disclosure to utilize a plurality of substructure raising apparatuses 130, e.g., two, three, four or even more raising apparatuses 130, near each corner of the telescoping substructure 100. Furthermore, while FIG. 1C illustrates only one structural support member 114 near each corner of the telescoping substructure 100, it should be understood that a plurality of structural support members 114 may be used at each corner location, depending on the specific design and/or quantity of raising apparatuses 130 utilized. For example, in those illustrative embodiments wherein a plurality of raising apparatuses 130, e.g., two or more, are used at each corner location, two or more structural support members 114 may also be used. Furthermore, when two or more structural support members 114 are used, they may be arranged in any appropriate or suitable configuration, such as parallel spaced apart members or cross members and the like, depending on the specific rig design considerations such as the number of raising apparatuses 130, the anticipated lift and/or operating loads for the mobile drilling rig 300, etc.

Also as shown in FIGS. 1A and 1B, the mobile drilling rig 300 may include a drilling rig mast 200 positioned above the telescoping substructure 100 and the drilling floor 101. In certain embodiments, the drilling rig mast 200 may include a bottom mast section 220 and an upper mast section 240. Depending on the specific mast design parameters, the drilling rig mast 200 may be pivotably attached to and supported by mast support shoes 210, which may be fixedly attached, e.g., bolted, to the upper substructure boxes 110*u*, 120*u*. Furthermore, the drilling rig mast 200 may also be removably attached to and further supported by an A-frame structure 235, as shown in FIG. 1A. In at least some embodiments, the front legs of the A-frame structure 235 may be removably attached to and supported by the mast support shoes 210 (see, FIG. 1A), and the rear legs of the A-frame structure 235 may be removably attached to and supported by respective leg support shoes 211, which may also be fixedly attached to the upper substructure boxes 110*u*, 120*u*.

It should be appreciate by a person of ordinary skill in the art after a full reading of the subject matter disclosed herein that the configuration of the drilling rig mast 200 shown in FIGS. 1A and 1B and described above is exemplary only, and that other mast design configurations may also be used that are within the spirit and scope of the present disclosure.

FIGS. 2A-2J depict various aspects of an illustrative telescoping substructure box 110, such as the driller's side 300*a* telescoping substructure box 110 shown in FIGS. 1A-1C. It should be understood, however, that while the details described with respect to FIGS. 2A-2J are specific to the driller's side 300*a* telescoping substructure box 110, the following description is also generally applicable to the respective details of an off-driller's side 300*b* telescoping substructure box 120.

Figure 2B:
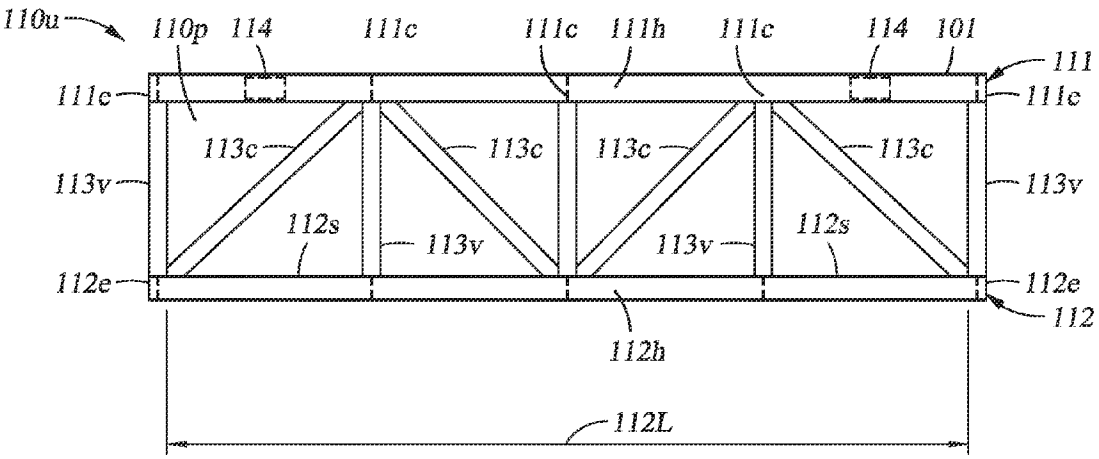
FIGS. 2A-2C are end elevation, side elevation, and plan views, respectively, of one illustrative embodiment of an upper telescoping substructure box disclosed herein.
Figure 2A:
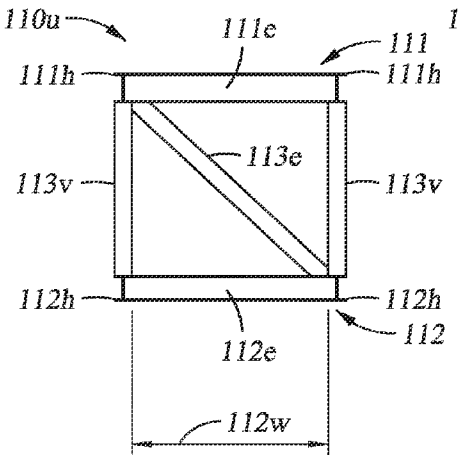
Figure 2C:
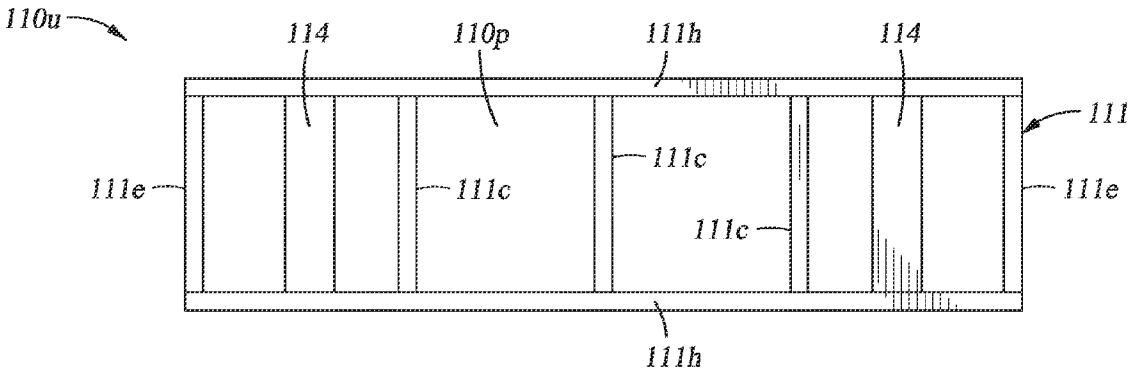

FIGS. 2A, 2B, and 2C are end elevation, side elevation, and plan views, respectively, of an illustrative upper substructure box 110*u*. As shown in FIGS. 2B and 2C, the upper substructure box 110*u* may include upper horizontal structural members 111*h* and lower horizontal structural member 112*h* running along either side of the upper substructure box 110*u*. In some embodiments, the upper horizontal structural members 111*h* may be separated from the lower horizontal structural members 112*h* by a plurality of vertical structural members 113*v* and a plurality of cross members 113*c*, as shown in FIG. 2B. Furthermore, the upper substructure box 110 may include an appropriately designed structural support member 114, or a plurality of structural support members 114 as descried above, which may be fixedly attached, e.g., welded or bolted, at each end thereof to a respective horizontal structural member 111*h*. In some embodiments, each structural support member 114 may be appropriately positioned and adapted to transfer loads from the telescoping substructure 100, or the fully assembled mobile drilling rig 300, to a respective substructure raising apparatus 130, as previously described.

Additionally, as shown in FIG. 2A, the respective upper horizontal structural members 111*h* on opposite sides of the upper substructure box 110*u* may be separated by upper horizontal end members 111*e* and one or more upper horizontal cross members 111*c* extending therebetween, which may be used to stabilize the upper horizontal structural members 111*h* and support the drilling floor 101 (see, FIGS. 1A and 1B). Together, the structural members 111*h*, 111*e* and 111*c* and 114 may define an upper frame 111. Furthermore, the respective lower horizontal structural members 112*h* may be separated by lower horizontal end members 112*e*. Additionally, an end cross member 113*e* may also run across each end of the upper substructure box 110*u* between the upper and lower horizontal end members 111*e* and 112*e*, and/or between the vertical structural members 113*v* located at each end of the upper substructure box 110*u*.

In certain exemplary embodiments, unlike the upper horizontal cross members 111*c* and structural support members 114 extending between the opposing upper horizontal structural members 111*h*, there may be no cross members other than the end members 112*e* extending between the opposing lower horizontal structural members 112*h*. Accordingly, it should be understood that the lower horizontal structural members 112*h* and the lower horizontal end members 112*e* extending therebetween may define a substantially "open" bottom frame 112 having an inside end-to-end length 112L and an inside side-to-side width 112*w*. Furthermore, the inside length 112L and inside width 112*w* of the bottom frame 112 may be sized so as to allow the insertion of the lower substructure box 110L therethrough. Additionally, in at least some embodiments, the plurality of various structural members 111*h*, 111*c*, 111*e*, 112*h*, 112*e*, 113*v*, 113*c* and 114 of the upper substructure box 110*u* may be arranged so as to define a substantially "open" interior space 110*p*. Moreover, the substantially "open" interior space 110*p* may be sized to receive at least a portion of the lower substructure box 110L after it is inserted through the substantially "open" bottom frame 112, thereby facilitating at least a partial "nesting" of the lower substructure box 110L within the upper substructure box 110*u*, and a consequent "telescoping" operation of the telescoping substructure box 110, as will be further described with respect to FIGS. 2G-2J below.

FIGS. 2D, 2E, and 2F are end elevation, side elevation, and plan views, respectively, of an illustrative lower substructure box 110L. As shown in FIGS. 2E and 2F, the lower substructure box 110L may include upper horizontal structural members 115*h* running along either side of the lower substructure box 110L. As shown in FIG. 2F, the respective upper horizontal structural members 115*h* on opposite sides of the lower substructure box 110L may be separated by upper horizontal end members 115*e* and one or more upper horizontal cross members 115*c*, thus defining an upper frame 115 having an outside end-to-end length 115L and an outside side-to-side width 115*w*. In certain illustrative embodiments, the lower substructure box 110L may include a base support box 118 at each end thereof, each of which may include lower horizontal structural members 116*h* running along either side of the lower substructure box 110L. Additionally, the lower horizontal structural members 116*h* of each base support box may be separated from the upper horizontal structural members 115*h* by a plurality of vertical structural members 117*v* and a plurality of cross members 117*c*. Furthermore, the respective lower horizontal structural members 116*h* may be separated by lower horizontal end members 116*e* located on either end of each base support box 118. In some embodiments, an end cross member 117*e* may also run across each end of the lower substructure box 110L between the upper and lower horizontal end members 115*e* and 116*e*, and/or between the vertical structural members 117*v* located at each end of the lower substructure box 110L.

It should be appreciated by those of ordinary skill that the specific structural configurations of the upper and lower substructure boxes 110*u* and 110L illustrated in FIGS. 2A-2F and described above are exemplary only, and that other design configurations may also be used that generally fall with in the spirit and scope of the present disclosure.

In at least some illustrative embodiments of the telescoping substructure box 110 disclosed herein, the upper and lower substructure boxes 110*u* and 110L may be sized and configured so that the lower substructure box 110L fits inside of the upper substructure box 110*u*. More specifically, as noted above, the size of the lower substructure box 110L, i.e., the size of the upper frame 115, may be adapted so that the lower substructure box 110L may be inserted through the substantially "open" bottom frame 112 and at least partially "nested" within the substantially "open" interior space 110*p* of the upper substructure box 110*u*, thereby facilitating a sliding engagement, or "telescoping" action, between the two substructure boxes 110*u*, 110L. For example, the outside end-to-end length 115L of the lower substructure box 110L (i.e., outside of the upper horizontal end members 115*e*, as shown in FIG. 2F) may be adjusted so that it is less than the inside end-to-end length 112L (i.e., inside of the lower horizontal end members 112*e*, as shown in FIG. 2B) of the upper substructure box 110*u*. Similarly, the outside side-to-side width 115*w* of the lower substructure box 110L (i.e., outside of the upper horizontal structural members 115*h*, as shown in FIG. 2F) may also be adjusted so that it is less than the inside side-to-side width 112*w* (i.e., inside of the lower horizontal structural members 112*h*, as shown in FIG. 2A) of the upper substructure box 110*u*. Furthermore, in certain embodiments, one or both of the substructure boxes 110*u* and 110L may also include appropriately sized and positioned alignment members (not shown), such as rails, guides, tracks, and the like, so as to maintain a proper alignment of the substructure boxes 110*u* and 110L during the above-described telescoping action, e.g., when the telescoping substructure box 110 is being raised or lowered.

Figure 2H:
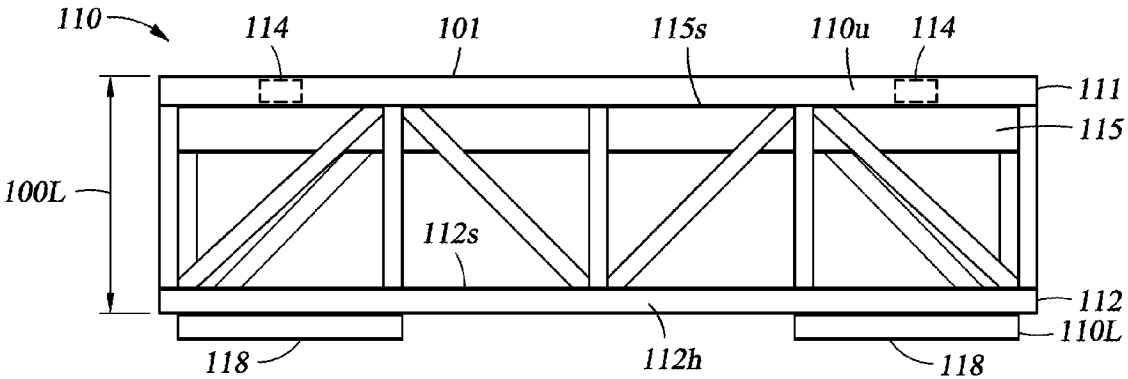
FIGS. 2G and 2H are end and side elevation views, respectively, of the upper and lower telescoping substructure boxes of FIGS. 2A-2D in an assembled and collapsed configuration.
Figure 2G:
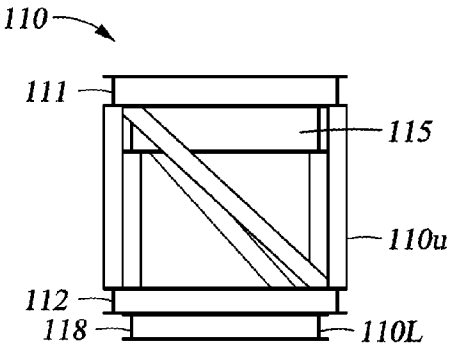

FIGS. 2G and 2H are end and side elevation views, respectively, of the driller's side 300*a* telescoping substructure box 110 in a fully collapsed configuration, wherein the substructure raising apparatuses 130, skid feet 131, and skid foot movement apparatuses 132 are not shown for clarity. As shown in FIGS. 2G and 2H, almost the entirety of the lower substructure box 110L may be inserted into the upper substructure box 110*u* from below, and the two substructure boxes 110*u* and 110L may be telescoped together until the upper frame 115 on the lower substructure box 110L is positioned adjacent to the upper frame 111 on the upper substructure box 110*u*. Furthermore, an upper surface 115*s* of the upper frame 115 on the lower substructure box 110L may also be positioned adjacent to, or even substantially in contact with, the structural support members 114 and/or the upper horizontal cross members 111*c* of the upper frame 111 on the upper substructure box 110*u*. In this configuration, the telescoping substructure box 110 is in a substantially fully collapsed configuration, and has a fully collapsed or lowered height 100L that, in some embodiments, may be approximately 10-12 feet, whereas in other embodiments, the lowered height 100L may be in the range of approximately 15-18 feet. However, it should be appreciated by those having ordinary skill in the art after having the full benefit of the subject matter disclosed herein that the lowered height 100L may be adjusted as necessary depending on the specific rig design and overall substructure height requirements during rig operations.

Figure 2J:
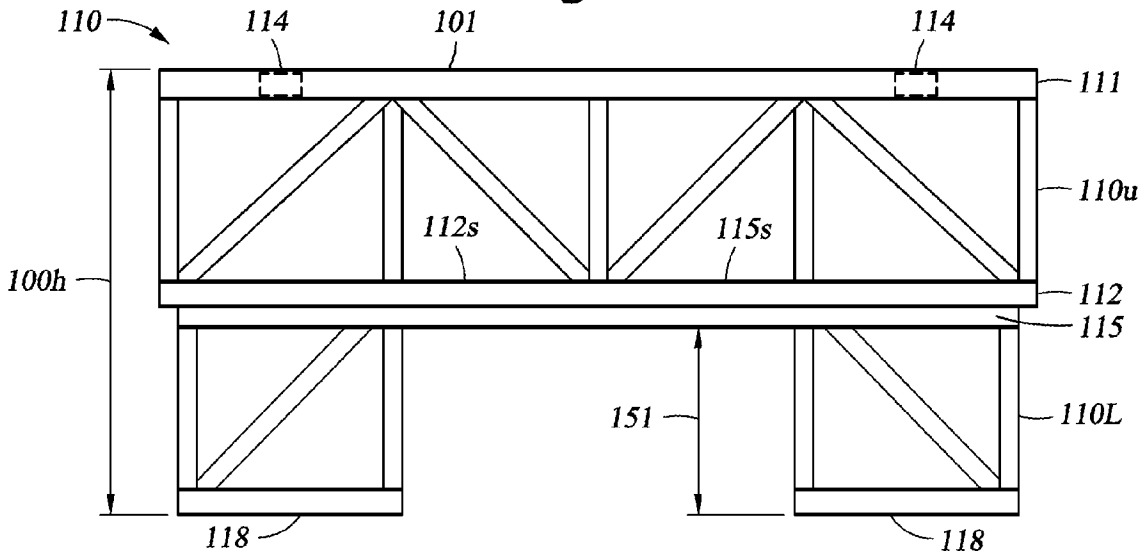
FIGS. 2I and 2J are end and side elevation views, respectively, of the upper and lower telescoping substructure boxes of FIGS. 2A-2D in an assembled and raised configuration.
Figure 2I:
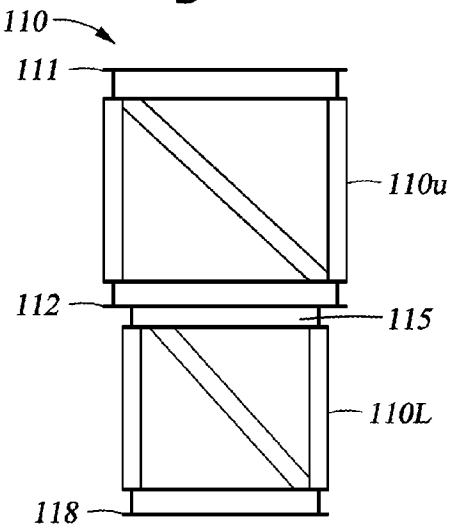

FIGS. 2I and 2J are end and side elevation views, respectively, of the driller's side 300*a* telescoping substructure box 110 in a fully raised configuration, wherein the substructure raising apparatuses 130, skid feet 131, and skid foot movement apparatuses 132 are again not shown for clarity. As shown in FIGS. 2I and 2J, the upper substructure box 110*u* may be telescoped up relative to the lower substructure box 110L until the upper frame 112 on the upper substructure box 110*u* is positioned adjacent to the upper frame 115 on the lower substructure box 110*u*. Furthermore, an upper surface 112*s* of the upper frame 112 on the upper substructure box 110*u* may also be positioned adjacent to, or even substantially aligned, with the upper surface 115*s* of the upper frame 115 on the lower substructure box 110L, as shown in FIG. 2J. In this configuration, the telescoping substructure box 110 is in a substantially fully raised—or "telescoped"—configuration. Furthermore, in at some exemplary embodiments, when the telescoping substructure box 110 is in the fully raised or "telescoped" configuration of FIG. 2J, it has a fully raised height 100*h* which may range from approximately 20-30 feet or even greater, depending on the overall design considerations of the mobile drilling rig 300. Furthermore, in the fully raised configuration, the telescoping substructure box 110 may also provide a side-to-side open space below the upper frame 115 and between the base support boxes 118 that substantially defines a side clearance 151. In some embodiments, the side clearance 151 may range from approximately 7-10 feet, while in other embodiments the side clearance 151 may be approximately 12-15 feet.

It should be understood that the particular configurations and relative arrangements of the upper and lower substructure box 110*u*, 110L (and by analogy, the upper and lower substructure boxes 120*u*, 120L) shown in FIGS. 2A-2J are illustrative only, and that other configurations and relative arrangements may also be used. For example, FIGS. 2A-2J illustrate a configuration and arrangement of the driller's side 300*a* telescoping substructure box 110 wherein the lower substructure box 110L is at least partially inserted into, or "nested" within, the substantially "open" interior space 110*p* of the upper substructure box 110*u*. It should be appreciated by those of ordinary skill after a full and complete reading of the present disclosure that the telescoping substructure box 110 may be configured and arranged such that the upper substructure box 110*u* is at least partially inserted into, or "nested" within, a corresponding "open" interior space of the lower substructure box 110L substantially without affecting the function and/or operation of the telescoping substructure box 110 or the telescoping substructure 100.

Figure 3A:
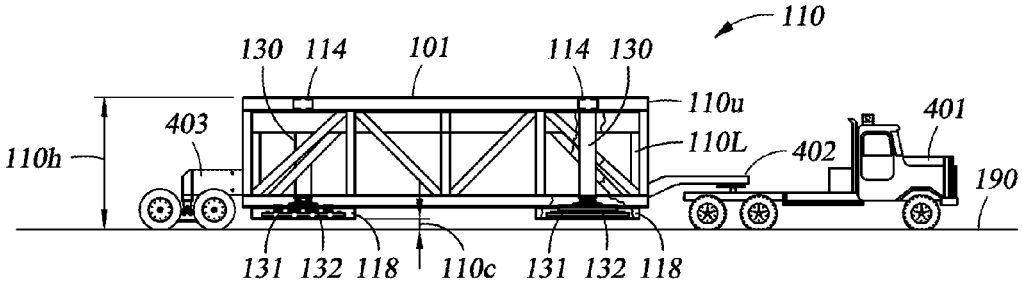
FIGS. 3A-3C are side elevation views of an early stage of assembling an illustrative mobile drilling rig disclosed herein, wherein a truck/trailering package is used to transport and position an illustrative telescoping substructure box in preparation for further rig assembly stages.
Figure 3B:
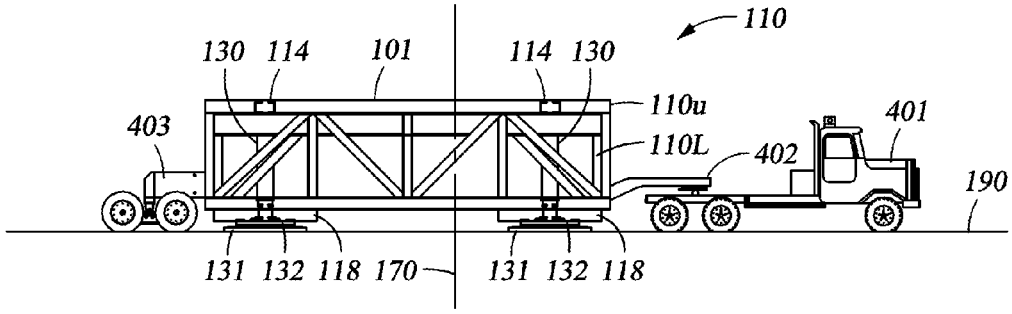
Figure 3C:
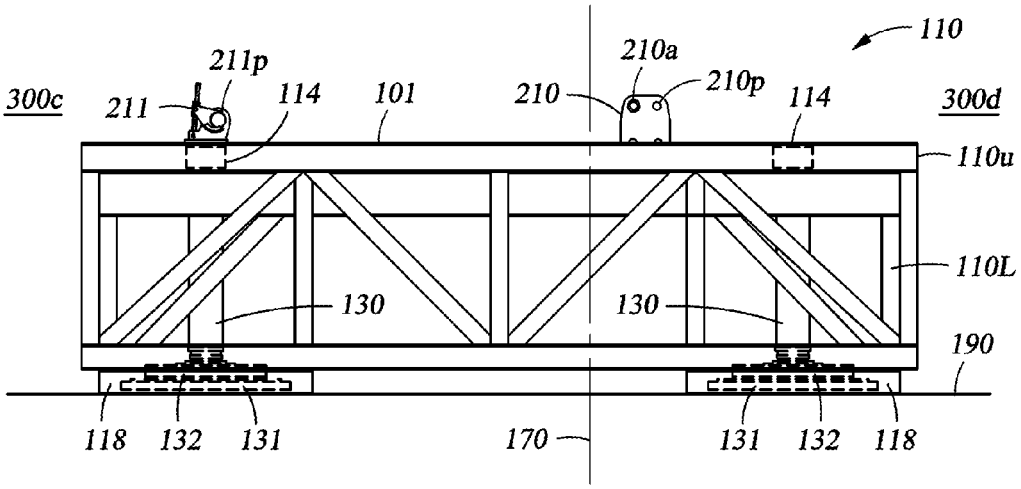

FIGS. 3A-3C are side elevation views of an illustrative telescoping substructure box 110 that is being transported and positioned on the ground 190 as a preliminary step in assembling the mobile drilling rig 300 illustrated in FIGS. 1A and 1B. While the details shown in FIGS. 3A-3C and described below are specifically directed to transporting and positioning the driller's side 300*a* telescoping substructure box 110, it should be understood that these details are also generally applicable to the off-driller's side 300*b* telescoping substructure box 120.

FIG. 3A depicts an illustrative driller's side 300*a* telescoping substructure box 110 that is being transported over the ground 190 by a truck 401. In some illustrative embodiments, a gooseneck 402 may be removably attached to one end of the telescoping substructure box 110, and a wheeled trailering package 403 may be removably attached to the opposite end of the telescoping substructure box 110. The gooseneck 402 may then be removably connected to a fifth wheel connection on the truck 401 so as to facilitate transportation of the telescoping substructure box 110 over highways and/or roads from one oilfield drilling site to another, as well as over the ground 190 at a given oilfield drilling site.

As shown in FIG. 3A, the telescoping substructure box 110 is typically transported over the ground 190 in a fully collapsed configuration, such that a clearance 110*c* is maintained between the ground 190 and the bottom of each skid foot 131. In certain illustrative embodiments, the clearance 110*c* is maintained during transportation of the telescoping substructure box 110 by temporarily attaching the lower substructure box 110L to the upper substructure box 110*u*, such as by the use of removable shear pins, bolts, clamps and the like (not shown). Furthermore, in at least some embodiments disclosed herein, when the wheeled trailering package 403 is attached and the telescoping substructure box 110 is being trailered by the truck 401 during road or highway transportation, a height 110*h* of the box 110 may be adapted so as to substantially comply with at least some height restrictions that may typically be imposed during such road and/or highway transportation.

FIG. 3B shows the telescoping substructure box 110 after it has been transported to a given oilfield drilling site and appropriately positioned proximate a wellbore location 170 (see, e.g., the wellbore location 170 shown in FIGS. 1A and 1B). In certain embodiments, the substructure raising apparatuses 130 shown in FIG. 3B may be actuated, i.e., extended, so as to lower the skid feet 131 relative to the upper and lower substructure boxes 110*u*, 110L and into bearing contact with the ground 190. Once the load of the telescoping substructure box 110 is supported by the substructure raising apparatuses 130 and skid feet 131, the removable gooseneck 402 and removable wheeled trailering package 403 may then be detached from the lower substructure box 110L and moved away as required. Next, in some embodiments, the substructure raising apparatuses may again be actuated, i.e., retracted, so as to lower the telescoping substructure 110 until the base support boxes 118 of the lower substructure box 110L are also in bearing contact with the ground 190, as shown in FIG. 3C. Thereafter, the devices used to temporarily attach the lower substructure box 110L to the upper substructure box 110*u*, e.g., pins, bolts, clamps, etc. (not shown), may be removed in preparation for telescoping the substructure box 110 during subsequent drill rig assembly activities, as will be further described with respect to FIGS. 4A-4C and 5A-5J below.

As noted previously, the above-described steps are typically performed after the telescoping substructure box 100 has been appropriately positioned proximate a specific wellbore location, such as the wellbore location 170. In some embodiments, the truck 401 may be used to trailer the telescoping substructure box 110 to a specified final location, after which the substructure raising apparatuses 130, i.e., means for "telescoping" the substructure box 110, may be used to lower the substructure box 110 in the manner described above. In other illustrative embodiments, the truck 401 may be used to position the telescoping substructure box 110 adjacent to the specified final location and the substructure box 110 lowered to the ground 190 as previously, after which the substructure box 110 may be skidded, i.e., moved, to the specified final location using the skid foot movement apparatuses 132 in the manner described with respect to FIGS. 7A and 7B below.

FIG. 3C shows the illustrative driller's side 300*a* telescoping substructure box 110 of FIGS. 3A and 3B after completion of the above-described steps. Furthermore, in at least some embodiments, a mast support shoe 210 may be removably attached to the upper substructure box 110*u*. Depending on the specific drilling rig mast design used for the mobile drilling rig 300, the mast support shoe 210 may be adapted to pivotably support a drilling rig mast, such as the drilling rig mast 200 shown in FIGS. 1A and 1B, by way of an appropriately sized pin hole 210*p*. Furthermore, the mast support shoe 210 may also include a second suitably sized pin hole 210*a*, which, in at least some embodiments, may be used to removably attach a front leg of an A-frame structure, such as the A-frame structure 235 of FIGS. 1A and 1B, to the mast support shoe 210. Additionally, a leg support shoe 211 may also be removably attached to the upper substructure box 110*u*, which may be used to removably attached a rear leg of the A-frame structure, such as the A-frame structure 235 of FIGS. 1A and 1B, to the telescoping substructure box 110 by way of an appropriately sized pin hole 211*p*.

Figure 4A:
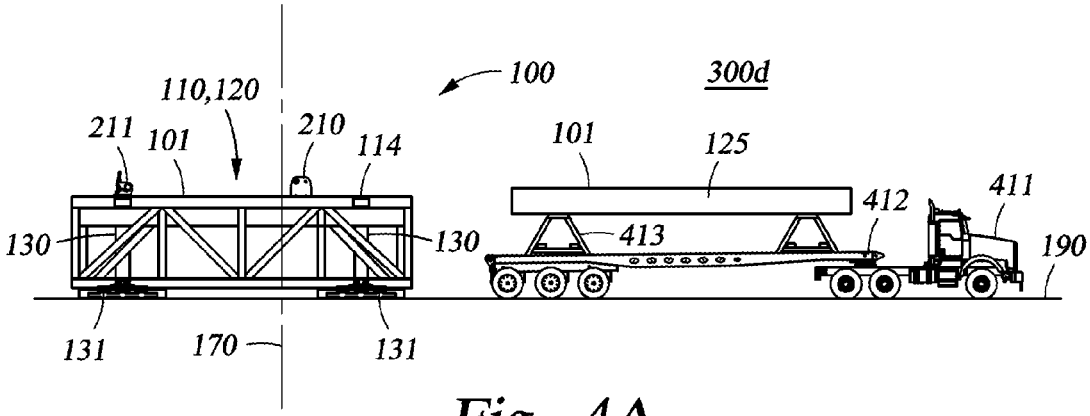
FIG. 4A is a side elevation view of one embodiment of a mobile drilling rig disclosed herein during a rig assembly stage wherein a substructure center floor section is being positioned by a truck/trailer combination adjacent to illustrative telescoping substructure boxes of the present disclosure.
Figure 4B:
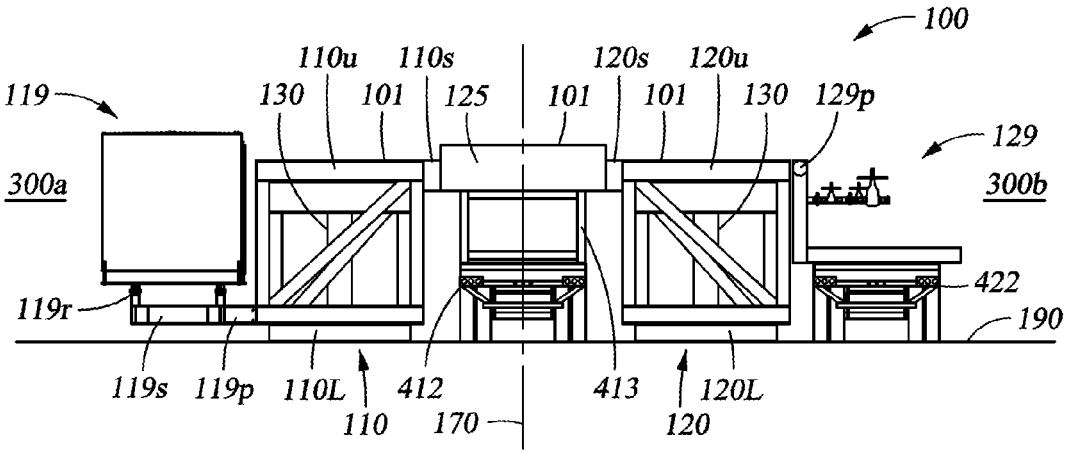
FIG. 4B is an end elevation view of the substructure center floor section and trailer of FIG. 4A being positioned between illustrative driller's side and off-driller's side telescoping substructure boxes.
Figure 4C:
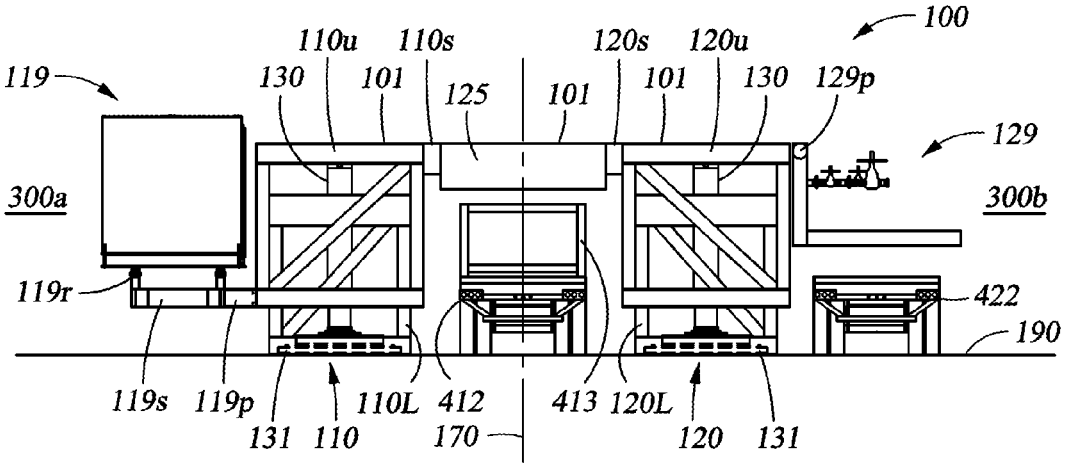
FIG. 4C is an end elevation view of the illustrative embodiment depicted in FIG. 4B during a further rig assembly stage, wherein the substructure center floor section is being lifted off of the trailer by raising the illustrative driller's side and off-driller's side upper telescoping substructure boxes.

FIGS. 4A-4C illustrate further assembly stages of the mobile drilling rig 300 disclosed herein, after the driller's side 300*a* and off-driller's side 300*b* telescoping substructure boxes 110 and 120 have been appropriately positioned proximate the wellbore location 170 in the manner previously described with respect to FIGS. 3A-3C above. More specifically, FIG. 4A is a side elevation view showing a substructure center floor section 125 being positioned adjacent to the telescoping substructure 100 for installation thereon. As shown in the illustrative embodiment of FIG. 4A, the substructure center floor section 125 may be positioned on a trailer 412 that is attached a truck 411, which may be used to move the trailer 412 over the ground 190 and adjacent to the telescoping substructure 100. In certain embodiments, the substructure center floor section 125 may be supported on the trailer 412 by support stands 413, which may be sized so as to hold the substructure center floor section 125 at an appropriate height for installation onto the telescoping substructure 100, as will be further described below.

FIG. 4B is an end elevation view of one embodiment of the telescoping substructure 100 disclosed herein, wherein the substructure center floor section 125 and trailer 412 of FIG. 4A have been positioned between the illustrative driller's side 300*a* and off-driller's side 300*b* telescoping substructure boxes 110 and 120. As shown by the illustrative rig assembly stage depicted in FIG. 4B, the drilling floor 101 on the substructure center floor section 125 may be positioned at a height level that is higher than the corresponding drilling floor 101 on each of the adjacent telescoping substructure boxes 110, 120 in advance of installing the center floor section 125 as shown in FIG. 4C and described below.

In some exemplary embodiments, the telescoping substructure boxes 110, 120 may be positioned so that they are laterally spaced apart and straddle the wellbore location 170 as shown in FIG. 4B. Furthermore, the trailer 412 supporting the substructure center floor section 125 may be positioned substantially directly above the wellbore location 170. In at least some exemplary embodiments, the telescoping substructure boxes 110, 120 may each include respective side support members 110*s*, 120*s* (schematically shown in FIG. 4B), which may be appropriately designed to support the substructure center floor section 125 by engaging corresponding connections (not shown) on the center floor section 125.

In certain embodiments, any or all ancillary structures that may be required for operation of the mobile drilling rig 300 disclosed herein may also be positioned for attachment to and/or installation on the telescoping substructure boxes 110, 120 during the rig assembly stage illustrated in FIG. 4B. For example, in some embodiments, a driller's side 300*a* ancillary structure 119, which may include a driller's cabin 119*a* and/or a control cabin 119*b* (see, FIG. 1B) may be supported by a structural support 119*s*, which in turn may be removably attached to the driller's side 300*a* upper substructure box 110*u* by way of an appropriately designed connection 119*p*. Furthermore, an ancillary structure raising apparatus 119*r*, such as a suitably designed scissors apparatus and the like, may be disposed between and attached to the ancillary structure 119 and the structural support 119*s*. In at least one embodiment, the ancillary raising apparatus 119*r* may be adapted to raise the ancillary structure 119 up to the level of the drilling floor 101 on the driller's side 300*a* telescoping substructure box 110. In other embodiments, an off-driller's side 300*b* ancillary structure 129 may be supported on a second trailer 422 attached to a second truck (not shown in FIG. 4B) and positioned adjacent to the off-driller's side 300*b* telescoping substructure box 120. The ancillary structure 129 may then be pivotably attached to the off-driller's side 300*b* upper substructure box 120*u* by way of a suitably designed pivotable connection 129*p*. It should be understood, however, that either or both of the ancillary structures 119, 129 may be attached to the respective telescoping substructure boxes 110, 120 during an earlier or later stage of drilling rig assembly.

FIG. 4C is an end elevation view of the illustrative telescoping substructure 100 depicted in FIG. 4B during a further rig assembly stage, wherein the substructure center floor section 125 is being lifted off of the trailer 412. In some exemplary embodiments, the substructure center floor section 125 may be lifted by actuating the substructure raising apparatuses 130, thereby telescoping, i.e., raising, both the driller's side 300*a* and off-driller's side 300*b* upper substructure boxes 110*u*, 120*u* relative to their respective lower substructure boxes 110L, 120L. As the upper substructure boxes 110*u*, 120*u* are raised, the respective side support members 110*s*, 120*s* may engage corresponding connections (not shown) on the substructure center floor section 125, thereby lifting the substructure center floor section 125 off of the support stands 413. Furthermore, the respective side support members 110*s*, 120*s* and their corresponding connections on substructure center floor section 125 may be adapted so that, when engaged, the level of the drilling floor 101 on the substructure center floor section 125 is substantially level and aligned with the corresponding drilling floor 101 on each telescoping substructure box 110, 120.

After the substructure center floor section 125 has been lifted off of the trailer 412 and is supported by the adjacent telescoping substructure boxes 110, 120, the truck 411 (see, FIG. 4A) may be used to move the trailer 412 away from the telescoping substructure 100, and the telescoping substructure 100 may be lowered back down to a fully collapsed configuration with the substructure center floor section 125 positioned thereon. Furthermore, it should be appreciated that, in those illustrative embodiments wherein the off-driller's side 300*b* ancillary structure 129 may have been previously positioned adjacent to the off-driller's side 300*b* telescoping substructure box 120 on a second trailer 422 and pivotably attached thereto as shown in FIG. 4B, the ancillary structure 129 will also be lifted off of the second trailer 422 when the substructure raising apparatuses 130 are actuated so as to "telescope" the telescoping substructure 100. Accordingly, the second trailer 422 may also be moved away from the telescoping substructure 100 prior to lowering the telescoping substructure 100 down to the fully collapsed configuration.

In some illustrative embodiments, the driller's side 300*a* ancillary structure 119 may also be moved into position on a trailer (not shown) in a substantially similar fashion to that shown in FIGS. 4B and 4C for the off-driller's side 300*b* ancillary structure 129. Moreover, the drawworks skid 141 with the drawworks 140 thereon (not shown in FIGS. 4A-4C; see, e.g., FIG. 1A, described above) may also be positioned adjacent to the drawworks side 300*c* of the telescoping substructure 100 in a similar manner, then attached to the upper substructure boxes 110*u*, 120*u* and lifted as described with respect to the ancillary structure 129 above.

Figure 5A:
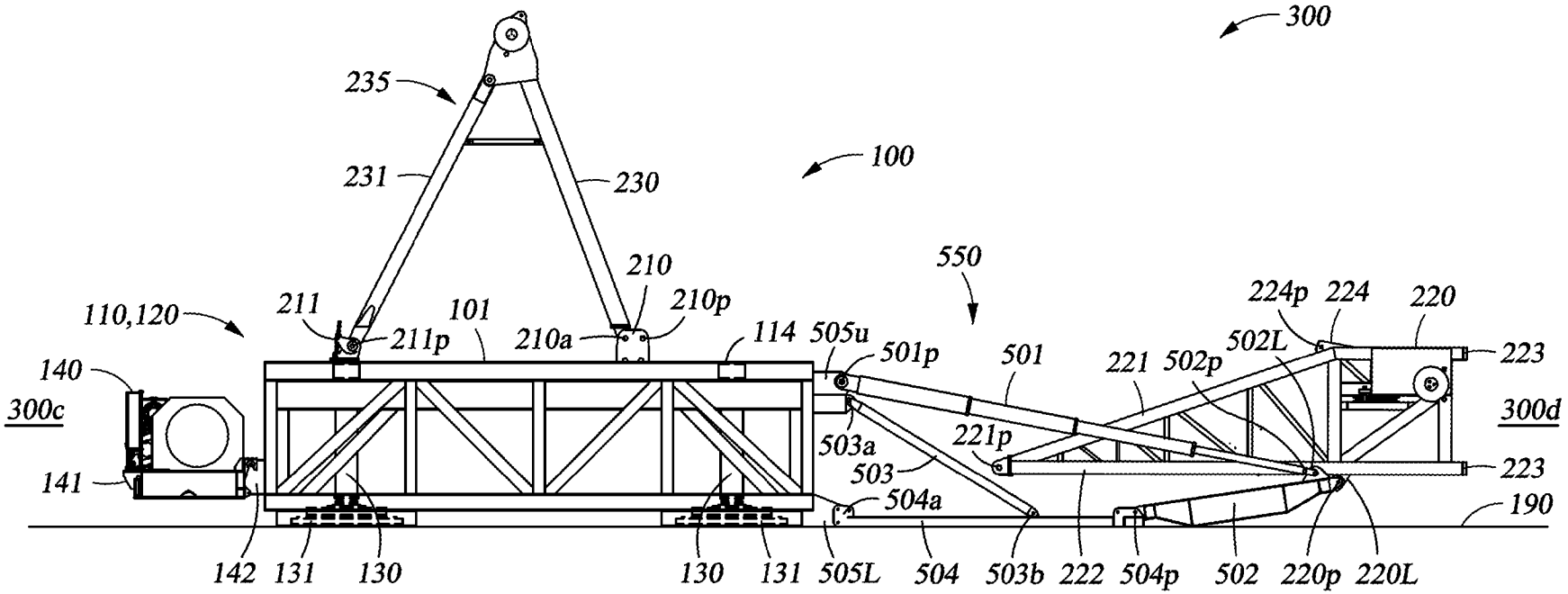
FIG. 5A is a side elevation view of an illustrative mobile drilling rig of the present disclosure during a later rig assembly stage, wherein a mast positioning apparatus has been attached to an illustrative telescoping substructure and a bottom mast section of a drilling rig mast has been pivotably attached to the mast positioning apparatus.

FIG. 5A is a side elevation view of an illustrative mobile drilling rig 300 of the present disclosure after the substructure center floor section 125 has been positioned on the telescoping substructure 100 as previously described with respect to FIGS. 4A-4C above. As shown in the illustrative rig assembly stage depicted in FIG. 5A, the drawworks skid 141 with the drawworks 140 thereon has also been attached to the support clips 142 on each of the upper substructure boxes 110*u*, 120*u*. Furthermore, the A-frame structure 235 has been installed above the drilling floor 101 by removably attaching the front legs 230 of the A-frame structure to the mast support shoes 210 at pin holes 210*a*, and by removably attaching the rear legs 231 thereof to the leg support shoes 211 at pin holes 211*p*.

In some exemplary embodiments disclosed herein, e.g., as illustrated in FIG. 5A, the mobile drilling rig 300 may also include mast positioning apparatuses 550 positioned on either side of a drilling rig mast, such as the drilling rig mast 200 shown in FIGS. 1A and 1B, and which may be used to position the drilling rig mast 200 adjacent to the mast support shoes 210 for attachment thereto. Generally, the mast positioning apparatuses 550 may be adapted to raise and pivotably position at least a bottom mast section 220 of the drilling rig mast 200 above the drilling floor 101 in such a manner that the pin holes 221*p* at the lower end of the bottom mast section 220 are positioned adjacent to, or even substantially aligned with, the corresponding pin holes 210*p* on the mast support shoes 210 as described in further detail below, thereby facilitating the erection of the drilling rig mast 200. In certain embodiments, the mast positioning apparatuses 550 may be removably attached to the telescoping substructure 100, and may each include, among other things, a mast erection apparatus 501, a bottom mast support spreader 502, a cross brace 503, and a base support 504, which will hereinafter be described in further detail.

In at least some embodiments, each of the mast erection apparatuses 501 may be, for example, a telescoping hydraulic or pneumatic cylinder and the like, which may be pivotably attached at one end to a respective upper support clip 505*u* on the telescoping substructure 100 at an appropriately designed pinned connection 501*p*. Furthermore, each mast erection apparatus 501 may also be pivotably attached at an opposite end thereof to a lug 502L on the bottom mast support spreader 502 at a pinned connection 502*p*. In other illustrative embodiments, the base support 504 may be fixedly attached, e.g., bolted, to a lower support clip 505L on the telescoping substructure 100 at a connection 504*a*. Also as shown in FIG. 5A, the upper end of the cross brace 503 may be pinned or fixedly attached, e.g., bolted, to the upper support clip 505*u* on the telescoping substructure 100 at a connection 503*a*, and the lower end of the cross brace 503 may be pinned or fixedly attached, e.g., bolted, to the base support 504 at a connection

504*b*. Additionally, the bottom mast support spreader 502 may be pivotably attached to the base support 504 at a pinned connection 504*p*.

As shown in FIG. 5A, and a bottom mast section 220 of a drilling rig mast 200 (see, e.g., FIGS. 1A and 1B) has also been pivotably attached to the bottom mast support spreader 502 of the mast positioning apparatus 550 at an appropriately designed pinned connection 220*p* on a suitably designed mast positioning lug 220L. In certain embodiments, the bottom mast section 220 may include, among other things, front support legs 222, rear support legs 221, and a plurality of suitably designed mast structure connections 223, which may be adapted to attach additional drilling rig mast sections, such as the upper mast section 240 shown in FIGS. 1A and 1B, to the bottom mast section 220. The bottom mast section 220 may also have a suitably sized pin hole 221*p* at the lower ends of each of the front and rear support legs 222, 221, which may be used to pivotably attach the drilling rig mast 200 to the mast support shoes 210 at the pin holes 210*p*. In other illustrative embodiments, the bottom mast section may also include mast erection lugs 224 with respective pin holes 224*p*, which may be used to pivotably connect the mast erection apparatuses 501 to the drilling rig mast 200 so as to facilitate mast erection, as will be further described with respect to FIGS. 5I, 5J and 6A below.

Figure 5B:
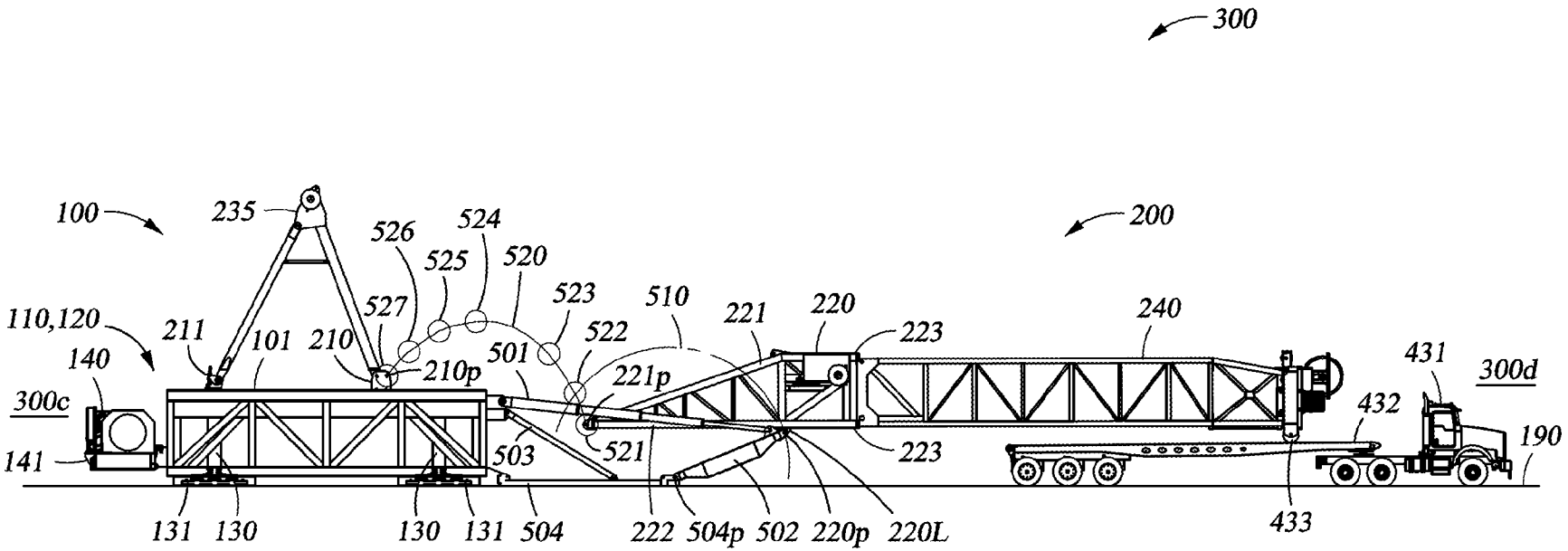
FIG. 5B shows an exemplary embodiment of the mobile drilling rig of FIG. 5A during a subsequent stage of rig assembly, wherein an upper mast section of the drilling rig mast has been attached to the bottom mast section.
Figure 5C:
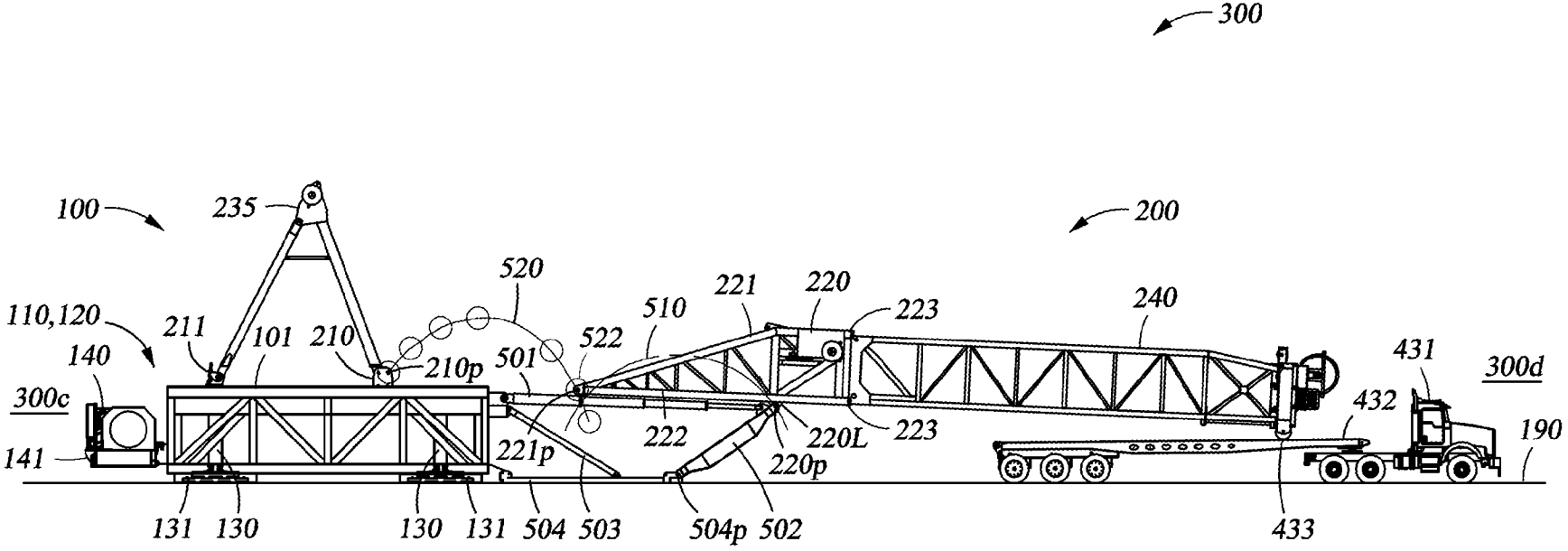
FIGS. 5C-5H show various sequential rig assembly stages of the illustrative mobile drilling rig depicted in FIG. 5B, wherein the mast positioning apparatus is being used to move the lower end of the bottom mast section into position adjacent to mast support shoes on the telescoping substructure.
Figure 5D:
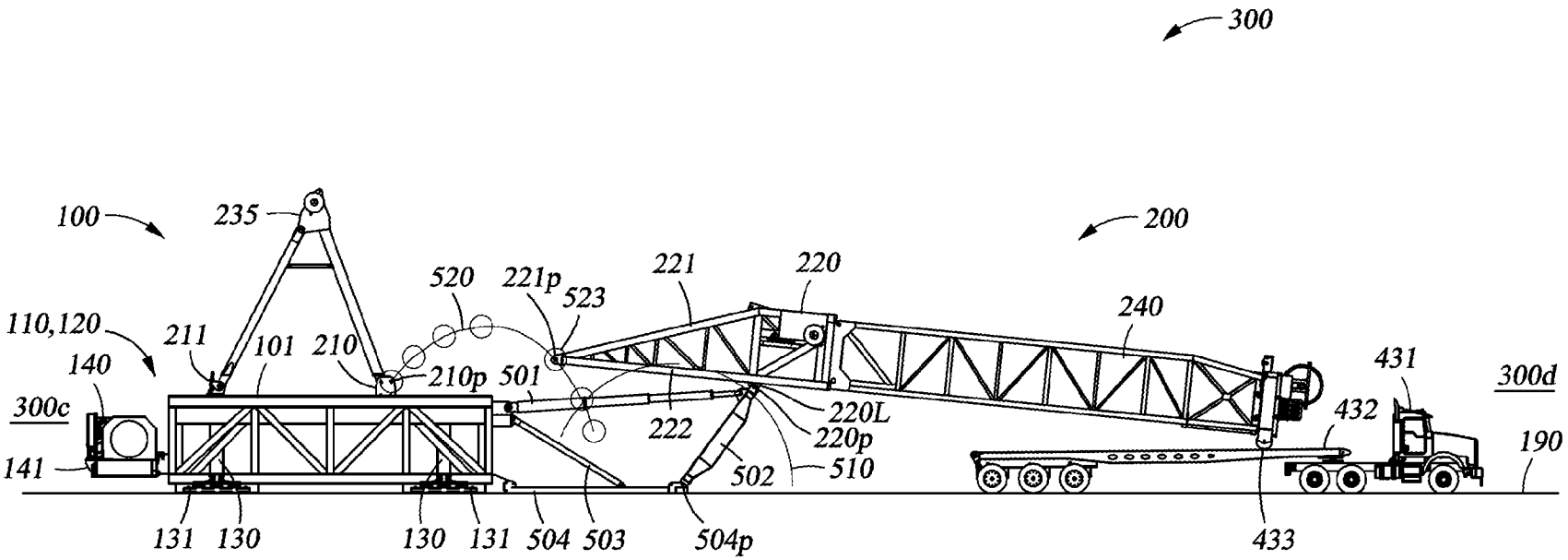
Figure 5E:
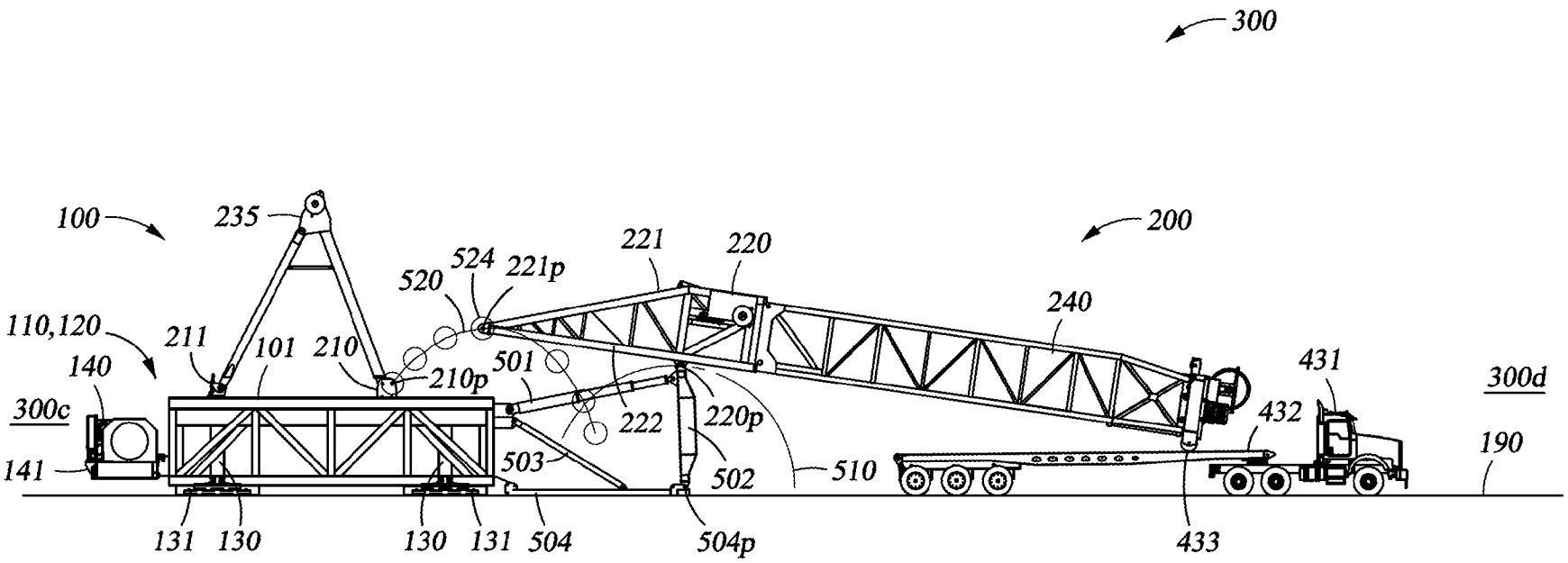
Figure 5F:
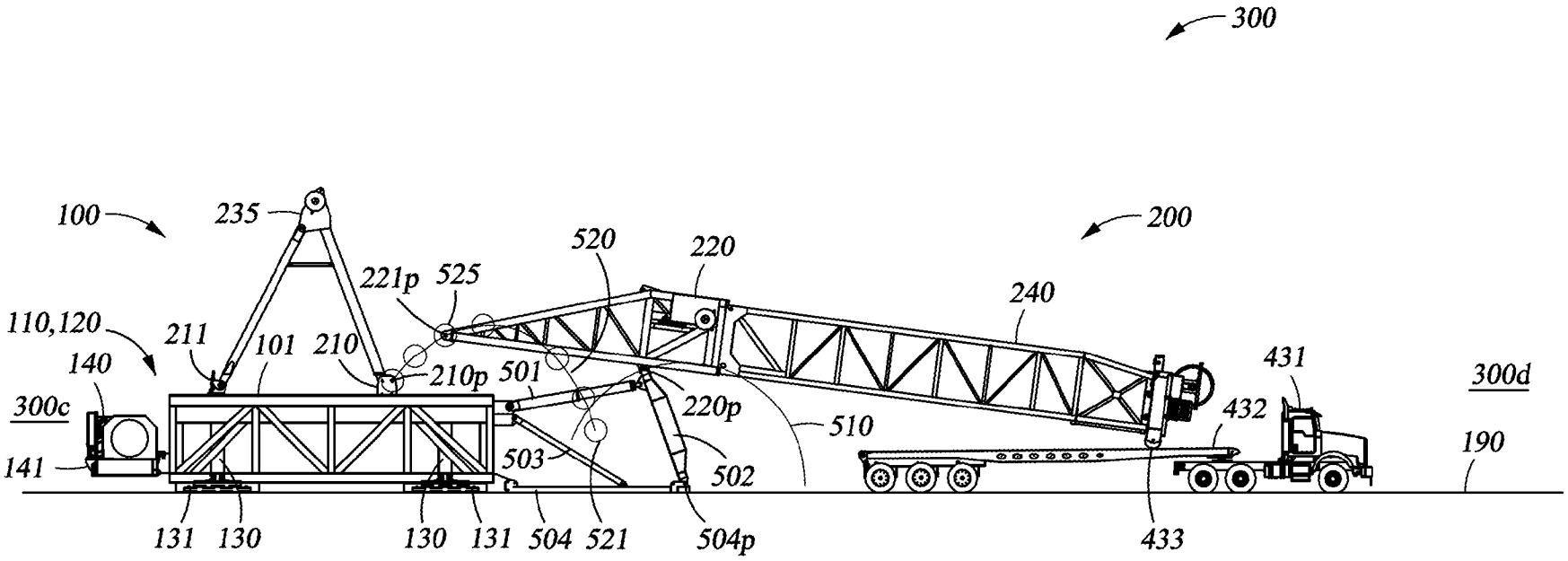
Figure 5G:
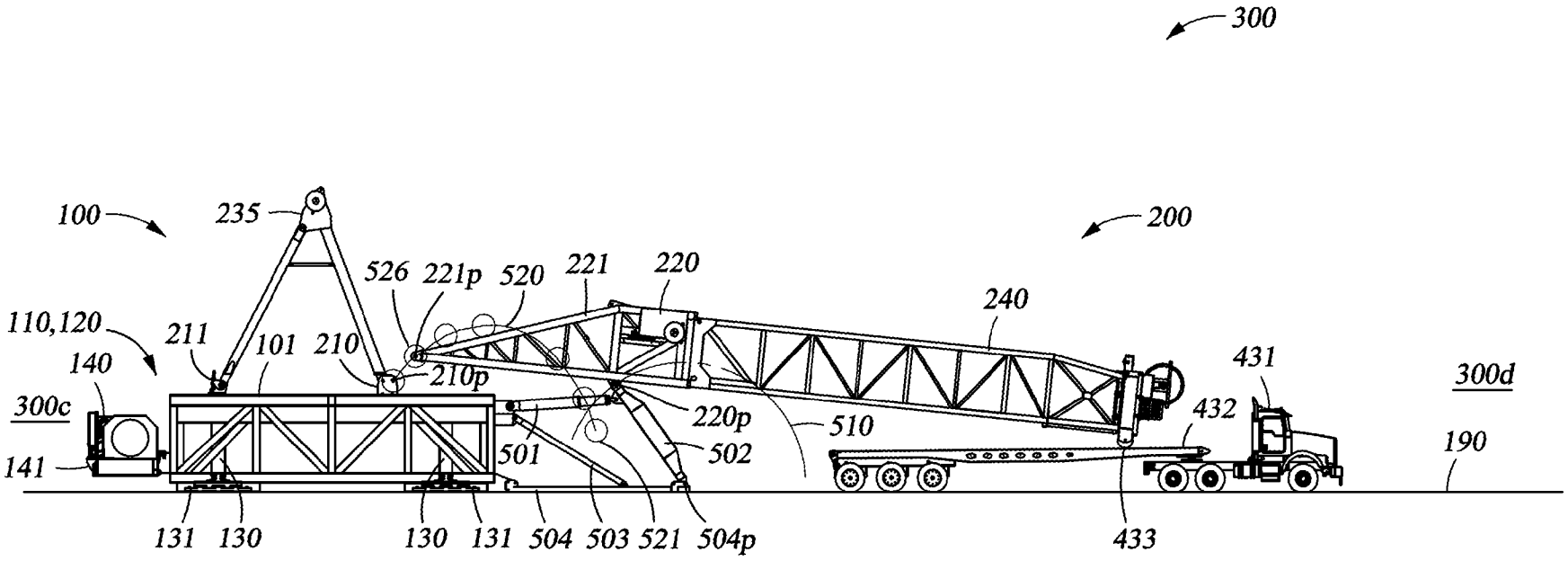

FIG. 5B depicts the illustrative mobile drilling rig 300 of FIG. 5A during a subsequent stage of rig assembly, wherein an upper mast section 240 of the drilling rig mast 200 has been attached to the bottom mast section 240. As shown in FIG. 5B, in some illustrative embodiments of the present disclosure, a lower end of the upper mast section 240 may be positioned adjacent to an upper end of the bottom mast section 220 by positioning the upper mast section 240 on a trailer 432, and using a truck 431 to move the trailer 432 over the ground 190 and into a proper position for further mast assembly activities. Thereafter, the upper mast section 240 may be removably attached to the bottom mast section 220 at the mast structure connections 223. As may be appreciated by those of ordinary skill, the upper mast section 240 may be a single section as depicted in the exemplary embodiment shown in FIG. 5B, whereas in at least some embodiments, the upper mast section 240 may be made up of one or more intermediate mast sections, depending on several rig design and logistical factors, including the mast height requirements, highway transportation load size restrictions, and the like.

FIG. 5B also schematically illustrates the movement of various rig elements as each mast positioning apparatus 550 is operated so as to move the drilling rig mast 200 into proper position above the drilling floor 101 of the telescoping substructure 100. More specifically, the arc 510 represents the path taken by a pinned connection 220*p* between one of the bottom mast support spreaders 502 and a respective mast positioning lug 220L on the bottom mast section 220 as the mast erection apparatus 501 of the mast positioning apparatus 550 is actuated, i.e., retracted, so as to pivot the bottom mast support spreader 502 about its pinned connection 504*p* to the base support 504. Similarly, the arc 520 represents the path taken by a pin hole 221*p* at the lower ends of respective front and rear support legs 222, 221 during the same operation. For example, after the upper mast section 240 has been attached to the bottom mast section 220, the pin hole 221*p* is in an initial position 521 as noted in FIG. 5B. Thereafter, as the mast erection apparatus 501 of the mast positioning apparatus 550 is retracted and the pinned connection 220*p* moves along the arc 510, the pin hole 221*p* moves along the arc 520 through representative intermediate sequential positions 522-526 before finally arriving at a final position 527. Accordingly, after the lower end of the drilling rig mast 200 has been pivotably positioned above the drilling floor 101 by the combined pivoting movements of the bottom mast support spreaders 502 and mast erection apparatuses 501 in the manner described above, the pin hole 221*p* may be positioned adjacent to, or even substantially aligned with, the pin hole 210*p* on a respective mast shoe 210.

FIGS. 5C-5G illustrate the various representative intermediate sequential positions 522-526 of the pin hole 221*p* as it moves along the arc 520 as described above. As shown in FIGS. 5C-5G, in some illustrative embodiments disclosed herein, the upper end of the drilling rig mast 200 may be allowed to freely roll along the trailer 432 on a suitably designed dolly or roller 433 as the mast positioning apparatus 550 is operated so as to move the lower end of the mast 200 into position above drilling floor 101. In other illustrative embodiments, the upper end of the drilling rig mast 200 may be simply supported on blocks or stands (not shown), in which case the truck 431 may be put into a neutral gear so that the truck/trailer combination 431, 432 may be allowed to freely roll toward the telescoping substructure 100 as the mast 200 is moved into position.

Figure 5H:
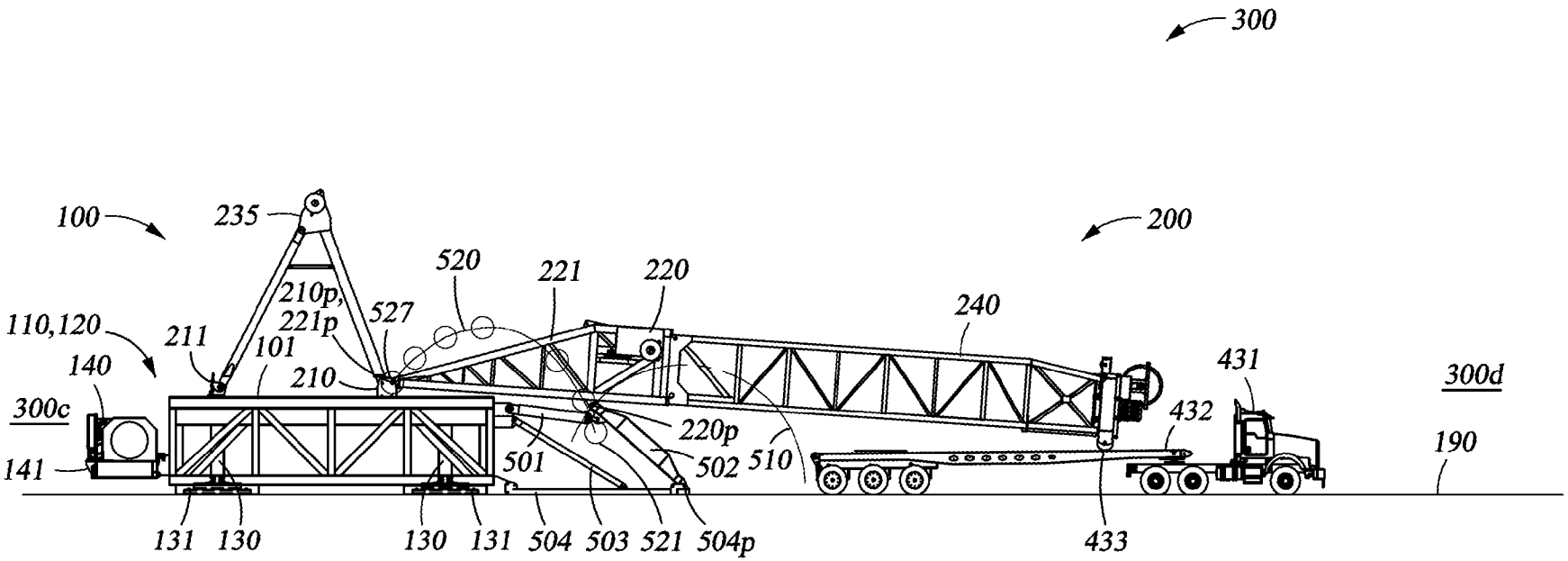

FIG. 5H depicts the illustrative mobile drilling rig 300 shown in FIGS. 5B-5G after the drilling rig mast 200 has been properly positioned above the drilling floor 101 of the telescoping substructure 100, i.e., wherein the pin holes 221*p* at the lower ends of the respective front and rear mast legs 222, 221 are in position 527, and are adjacent to or substantially aligned with corresponding pin holes 210*p* on respective mast support shoes 210. Thereafter, the drilling rig mast 200 may be pivotably attached to the mast support shoes 210 using the pin holes 210*p*, 221*p* and a suitably designed connecting pin (not shown).

Figure 5I:
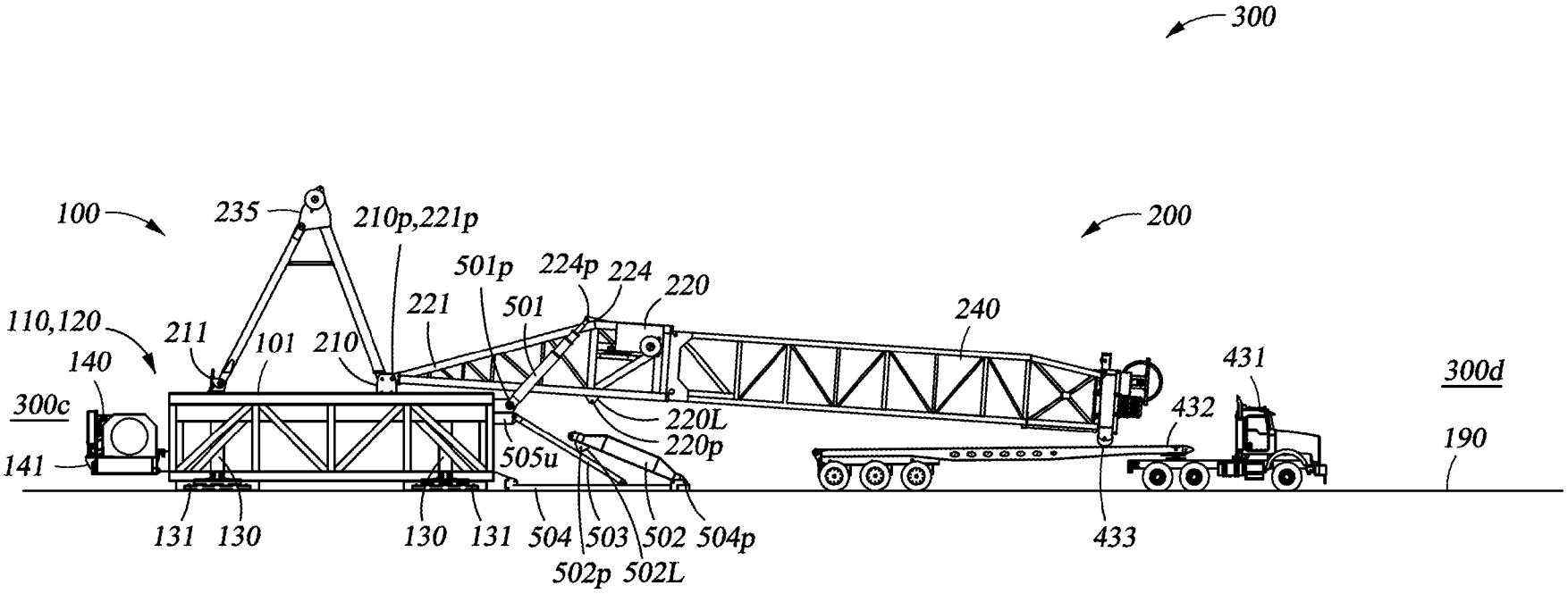
FIG. 5I depicts the mobile drilling rig of FIGS. 5B-5H in a further illustrative rig assembly stage, wherein the drilling rig mast has been pivotably attached to the mast support shoes and the mast raising apparatus has been pivotably attached to the drilling rig mast.

FIG. 5I depicts the mobile drilling rig 300 of FIGS. 5B-5H in a further illustrative stage of rig assembly, after the drilling rig mast 200 has been positioned above the drilling floor 101 and pivotably attached to the mast support shoes 210 as described above. As shown in the illustrative embodiment depicted in FIG. 5I, the drilling rig mast 200 may then be supported at its lower end by the mast support shoes 210 on the telescoping substructure 100, and at its upper end by the trailer 432, e.g., on the roller 433, or on blocks or stands (not shown in FIG. 5I), as previously described. Thereafter, the mast erection apparatuses 501 on either side of the drilling rig mast 200 may be detached from the pinned connections 502*p* on the lugs 502L of each respective bottom mast support spreader 502, pivoted about the pinned connections 501*p* to the upper support clips 505*u*, and pivotably attached to the mast erection lugs 224 at respective pin holes 224*p*. Additionally, each of the bottom mast support spreaders 502 may be unpinned from the pinned connections 220*p* on each respective mast positioning lug 220L, thereby releasing the bottom mast section 220 from the base support 504 and cross brace 503. In this configuration, the mast erection apparatuses 501 may be actuated, i.e., extended, so as to raise the drilling rig mast 200 off of the trailer 432 so that the truck/trailer combination 431, 432 can be moved away from the mobile drilling rig 300 as required.

Figure 5J:
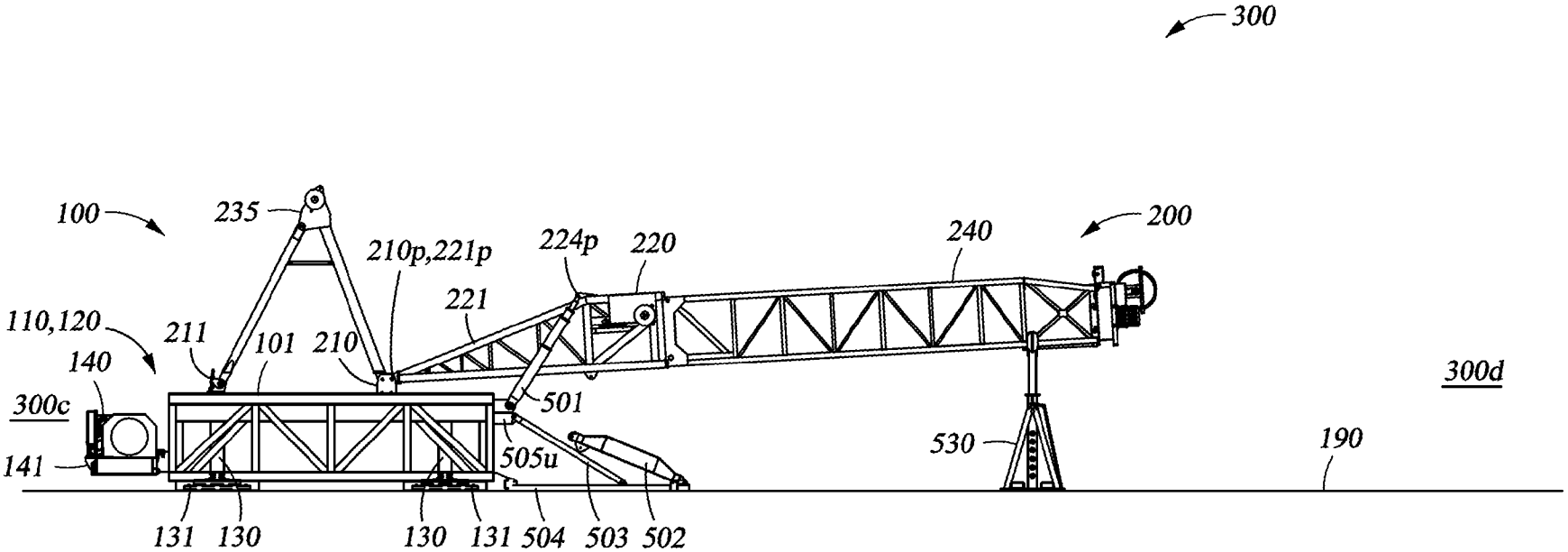
FIG. 5J shows the illustrative mobile drilling rig of FIG. 5I in yet a further stage of rig assembly, wherein the drilling rig mast has been lifted off of a truck/trailer combination and temporarily supported on a mast support stand.

FIG. 5J shows the illustrative mobile drilling rig 300 of FIG. 5I in yet a further stage of rig assembly, wherein the drilling rig mast 200 has been lifted off of the trailer 432, and the truck/trailer combination 431, 432 has been moved away from the rig 300 as described above. In certain exemplary embodiments disclosed herein, the drilling rig mast 200 may then be temporarily supported near its upper end on a suitably designed mast support stand 530, during which time additional rig dress-out activities may be performed. For example, in those illustrative embodiments wherein it might not already have been installed prior to mast transportation, additional rig operating equipment, such as traveling block equipment (not shown in FIG. 5J) and the like, may be installed on the drilling rig mast 200. Furthermore, in certain embodiments, ladders and/or access platforms, such as a derrickman's working platform (not shown), e.g., a monkeyboard or diving board platform, together with any requisite tubulars handling equipment (not shown), may also be attached to the drilling rig mast 200 prior to mast erection. In other embodiments, wherein one or more access platforms may have already been installed on the drilling rig mast 200 in a folded or collapsed configuration prior to transportation of the mast 200, these folded/collapsed platforms may be fully deployed prior to mast erection.

Figure 6A:
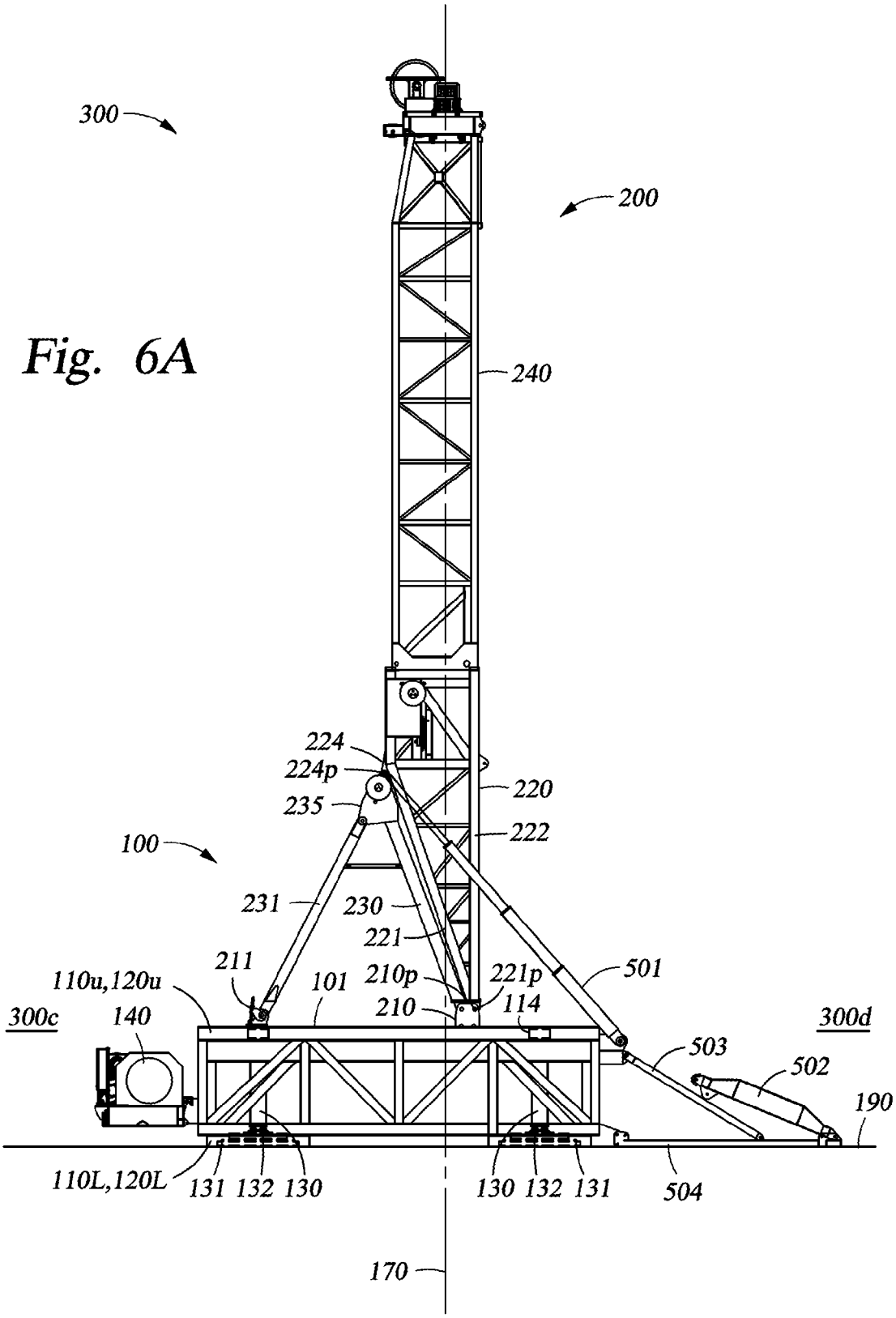
FIG. 6A is a side elevation view of one illustrative embodiment of a mobile drilling rig disclosed herein after the drilling rig mast has been raised to a substantially vertical orientation.

FIG. 6A is a side elevation view of the illustrative mobile drilling rig 300 shown in FIG. 5J in yet a further advanced stage of drilling rig assembly and erection. More specifically, FIG. 6A depicts the mobile drilling rig 300 after the mast erection apparatuses 501 have been actuated so as to raise the drilling rig mast 200 by pivotably rotating the mast 200 about the pinned connections (e.g., pin holes 210*p*, 221*p*) at each of the mast support shoes 210. In the illustrative embodiment shown in FIG. 6A, the drilling rig mast 200 has been raised until the rear support legs 221 of the mast 200 are adjacent to the front legs 230 of the A-frame structure 235, thereby placing the mast 200 in a substantially vertical operating orientation, i.e., substantially perpendicular to the ground 190.

It should be appreciated by those having ordinary skill in the art that the specific configuration and operating orientation of the drilling rig mast 200 is exemplary only, and that other mast configurations and operating orientations are well within the scope and spirit of the present disclosure. For example, in certain illustrative embodiments, such as those embodiments wherein the mobile drilling rig 300 may be adapted to perform near-surface directional drilling activities, the operating orientation of the drilling rig mast 200 may be less than 90° relative to the ground 190 (i.e., perpendicular as shown in FIG. 6A), e.g., an angled orientation such as 30°, 45°, 60° and the like. Furthermore, in such embodiments, the design of the A-frame structure 235 may be adjusted as required to provide the requisite support to the drilling rig mast 200 when the mast 200 is positioned in an angled operating orientation that is less than 90° relative to the ground 190. By way of example only, and depending on the actual operating orientation of the drilling rig mast 200, the A-frame structure 235 shown in FIG. 6A may be replaced by tension leg struts and/or similar structures that are adapted to provide the necessary support and stability during drilling operations.

Figure 6B:
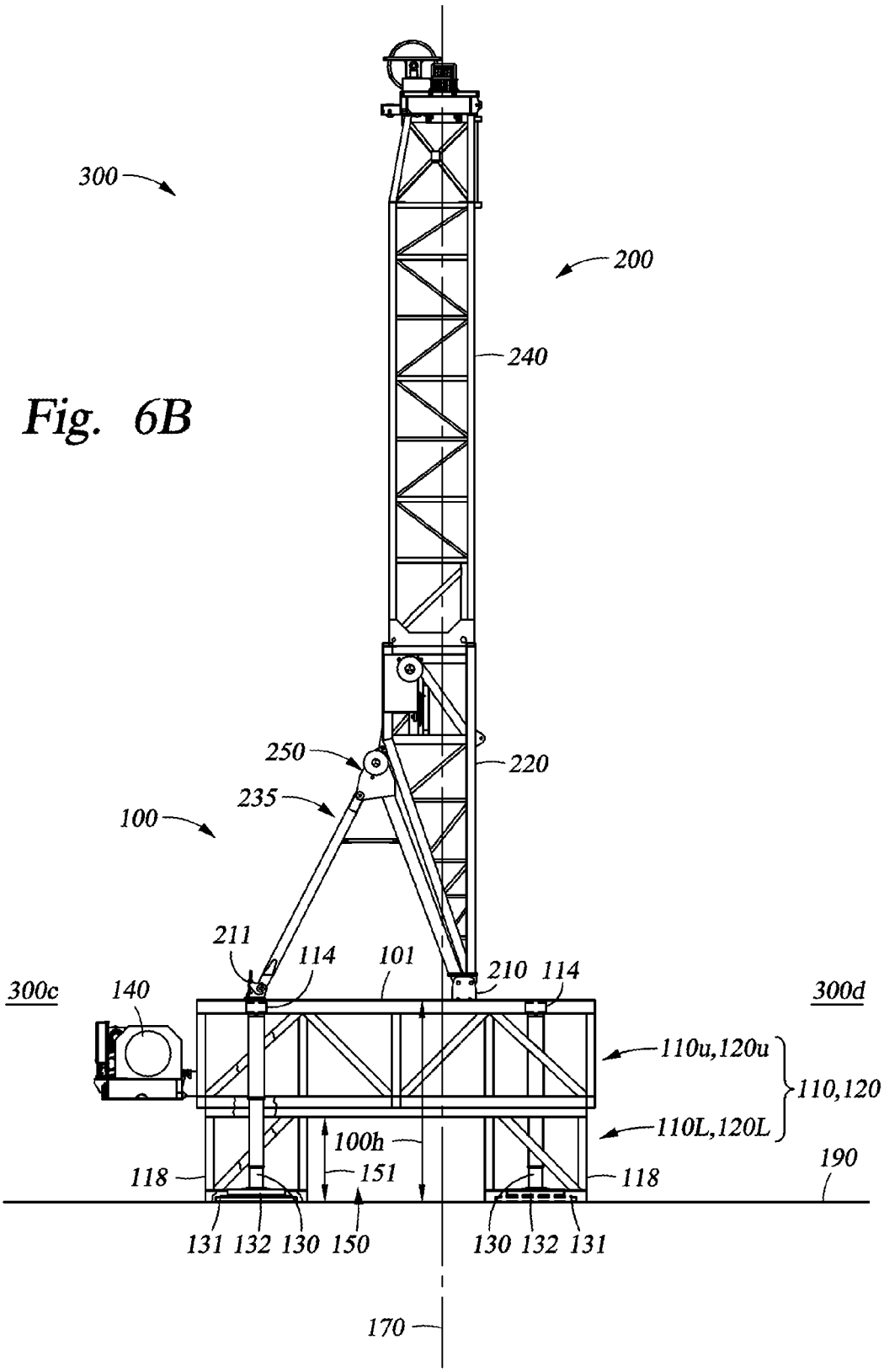
FIGS. 6B and 6C are side and end elevation views, respectively, of the mobile drilling rig of FIG. 6A after an illustrative telescoping substructure of the present disclosure has been used to raise the mobile drilling rig to an operating height.
Figure 6C:
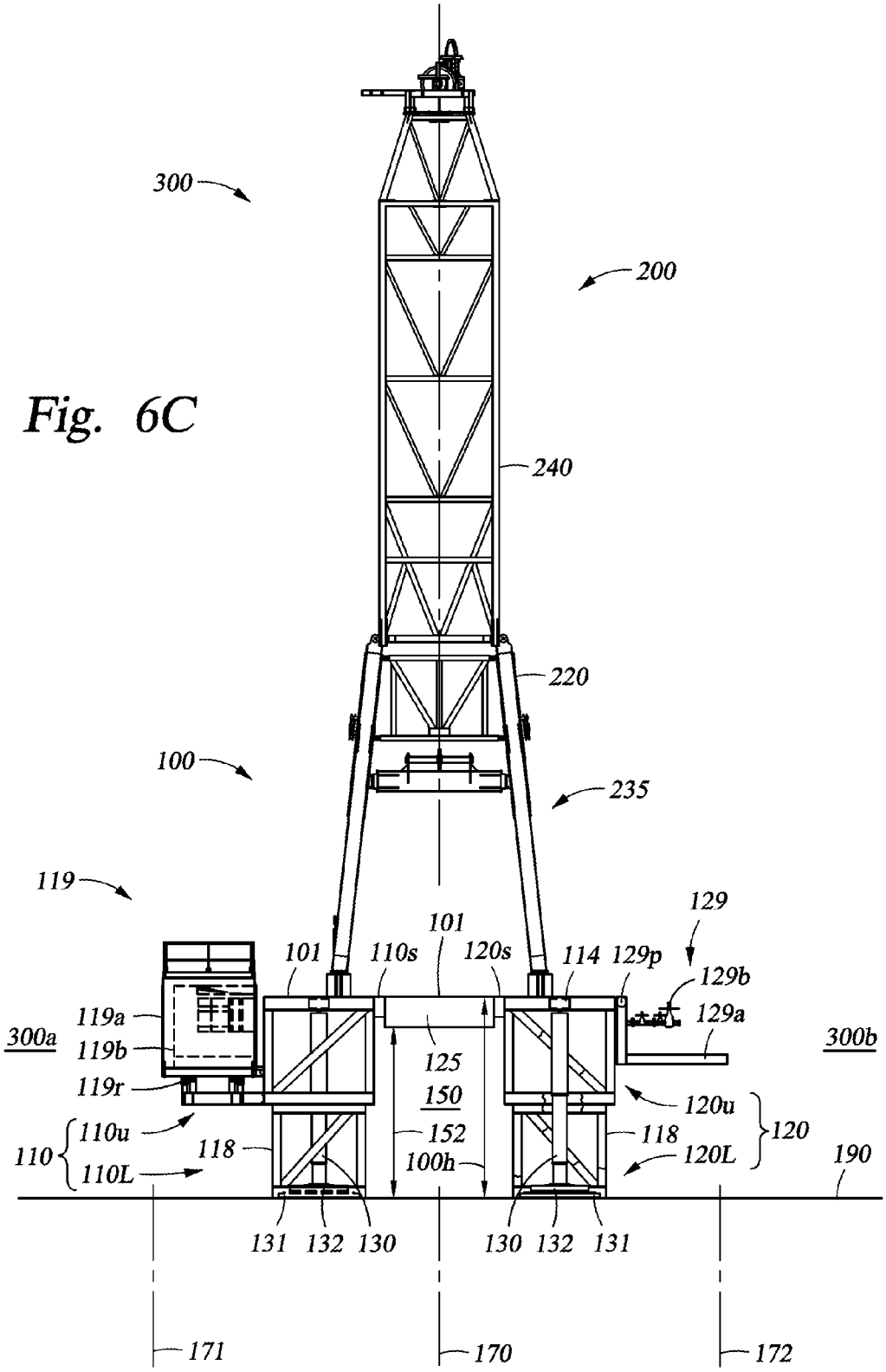

FIGS. 6B and 6C are side and end elevation views, respectively, of the mobile drilling rig 300 of FIG. 6A in a further illustrative stage of rig assembly and erection. As shown in FIG. 6B, in certain illustrative embodiments, the mast erection apparatuses 501 (not shown in FIG. 6B) may be detached from the mast erection lugs 224, and the drilling rig mast 200 may be securably attached to the A-frame structure 235 at an appropriately designed mast connection 250. Thereafter, in some exemplary embodiments, the telescoping substructure 100 may be used to raise the mobile drilling rig 300 to an operating height, e.g., such that the drilling floor 101 is at a height 100*h* above the adjacent ground 190, by actuating (i.e., extending) the substructure raising apparatuses 130 as previously described. For example, the telescoping substructure 100 may be raised to an operating height 100*h* that ranges anywhere from approximately 20-30 feet or even greater, depending on the overall design considerations of the mobile drilling rig 300.

As previously noted with respect to FIGS. 1A and 1B above, when the telescoping substructure 100 is raised to an operating height 100*h*, the illustrative mobile drilling rig 300 shown in FIGS. 6B and 6C has a drilling rig cellar area 150 that is located between the driller's side 300*a* and off-driller's side 300*b* telescoping substructure boxes 110, 120 and below the substructure center floor section 125. In at least some embodiments, the telescoping substructure 100 may provide a side clearance 151 in the cellar area 150, e.g., between the base support boxes 118 of each lower substructure box 110L, 120L and below the upper substructure boxes 110*u*, 1120*u*, that may range from approximately 7 feet to approximately 15 feet, depending on the range of the operating height 100*h*. It should be understood, however, that either greater or lesser side clearances 151 may also be used. Furthermore, in certain exemplary embodiments, the cellar area 150 may also have an end clearance 152 in the cellar area 150, e.g., between the telescoping substructure boxes 110, 120 and below the substructure center floor section 125, of approximately 17-27 feet or more, again depending on the specific operating height 100*h* of the telescoping substructure 100.

After the substructure raising apparatuses 130 have been used to "telescope" the telescoping substructure 100 to an operating height 100*h*, each upper substructure box 110*u*, 120*u* may be securably attached to a respective lower substructure box 110L, 120L, so that the dead load of the mobile drilling rig 300 can be transferred from the substructure raising apparatuses 130 to the telescoping substructure 100. For example, in some embodiments, a plurality of attachment devices (not shown in FIGS. 6B and 6C), such as bolts, clamps, shear pins, hydraulically actuated locking pins, and the like, may be used to securably attach the lower horizontal structural members of the upper substructure boxes 110*u*, 120*u* (see, e.g., members 112*h* and 112*e* of FIGS. 2A and 2B) to a respective upper horizontal structural members of the lower substructure boxes 110L, 120L (see, e.g., members 115*h* and 115*e* of FIGS. 2C and 2D). It should be appreciated, however, that other attachment devices and/or attachment points may also be used, depending on specific design of the telescoping substructure boxes 110 and 120. Accordingly, in this configuration, all rig dead loads, as well as any operating loads generated by the mobile drilling rig 300 during drilling operations, may be transferred from the upper substructure boxes 110*u*, 120*u*, through respective lower substructure boxes 110L, 120L, and subsequently to the ground 190.

As shown in the illustrative embodiment depicted in FIG. 6C, the ancillary structures 119, 129 may be attached to the respective driller's side 300*a* and off-driller's side 300*b* telescoping substructure boxes 110, 120, as previously described with respect to FIGS. 4B and 4C above. Accordingly, in at least some embodiments disclosed herein, after the telescoping substructure 100 has been raised to an operating height 100*h*, the ancillary structures 119, 129 may then be raised into an operating position, i.e., such that the structures 119, 129 are substantially aligned with the adjacent drilling floor 101 on each respective telescoping substructure box 110, 120, as shown in FIG. 1B. For example, the driller's side 300*a* ancillary structure 119 may be raised into an operating position by actuating the ancillary structure raising apparatus 119*r*, and thereafter securably attaching the ancillary structure 119 to an upper horizontal structural member 111*h* (see, FIGS. 2A and 2B above). Thereafter, the control cabin 119*b* may be moved into position above the drilling floor 101 on the driller's side 300*a* telescoping substructure box 110, as shown in FIG. 1B above.

Similarly, the off-driller's side 300*b* ancillary structure 129 may also be raised into an operating position after the telescoping substructure 100 has been raised to an operating height 100*h*. For example, the ancillary structure 129 may be raised by pivotably rotating the ancillary structure 129 about the pivotable connection 129*p* using, for example, powered hydraulic raising apparatuses (not shown) and the like. Thereafter, the ancillary structure 129 may be secured in the operating position using suitably designed supports (not shown), such as knee braces and the like.

While the illustrative embodiment depicted in FIG. 6C shows that the ancillary structures 119, 129 may be raised into an operating position after the mobile drilling rig 300 has been has been fully erected, this embodiment is exemplary only. Accordingly, it should be understood that in other embodiments, the ancillary structures 119, 129 may be raised to an operating position relative to the drilling floor 101 at substantially any time during the overall assembly and erection of the mobile drilling rig 300. For example, in certain exemplary embodiments, one or both of the ancillary structures 119, 129 may be raised into position adjacent to the drilling floor 101 prior to telescoping the telescoping substructure 100 to its operating height 100*h*.

Figure 7A:
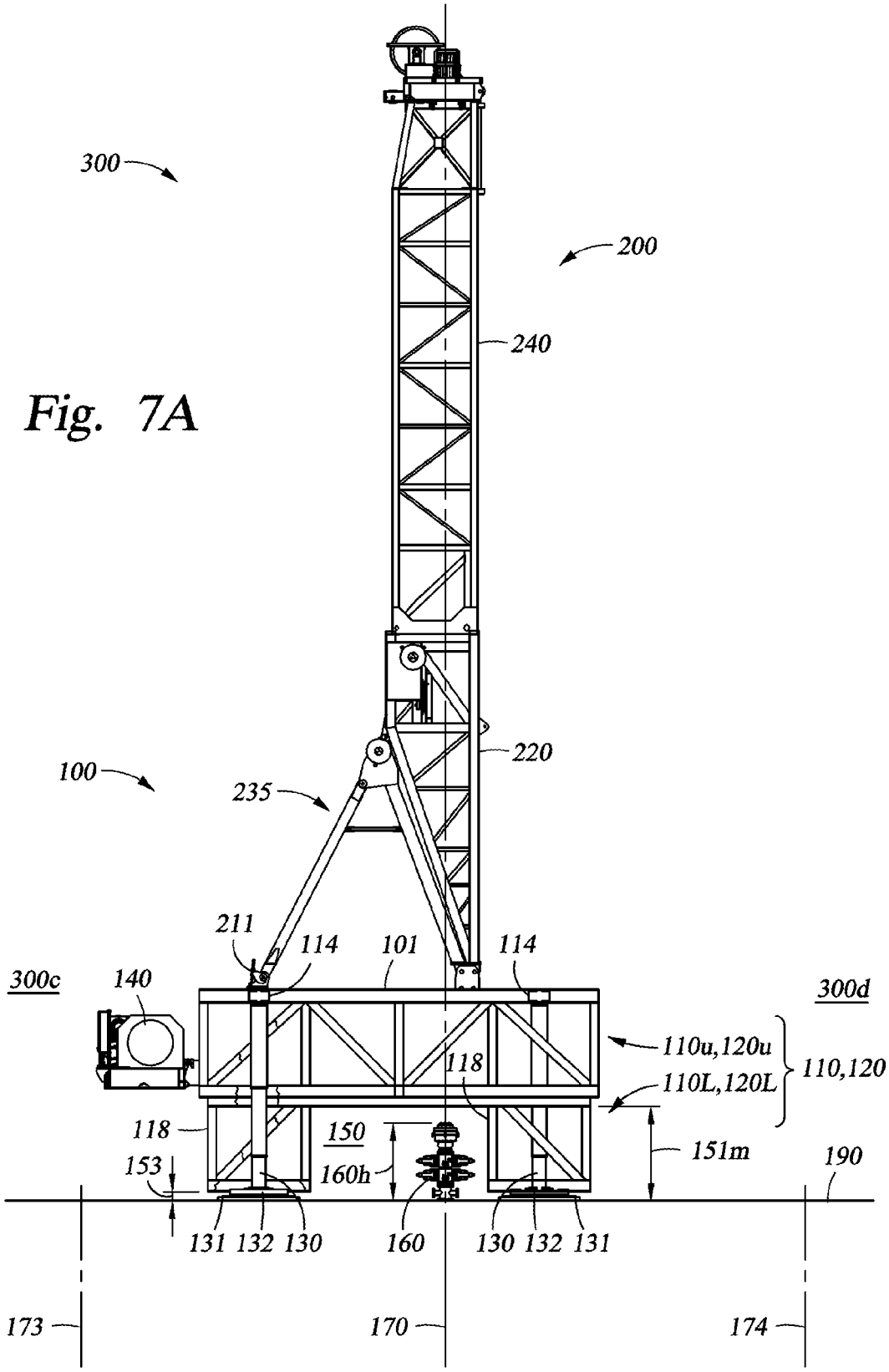
FIGS. 7A and 7B are side and end elevation views, respectively, of an exemplary mobile drilling rig of the present disclosure, wherein illustrative substructure raising apparatuses have been used to lift the mobile drilling rig in preparation for moving the rig to an adjacent wellbore location.
Figure 7B:
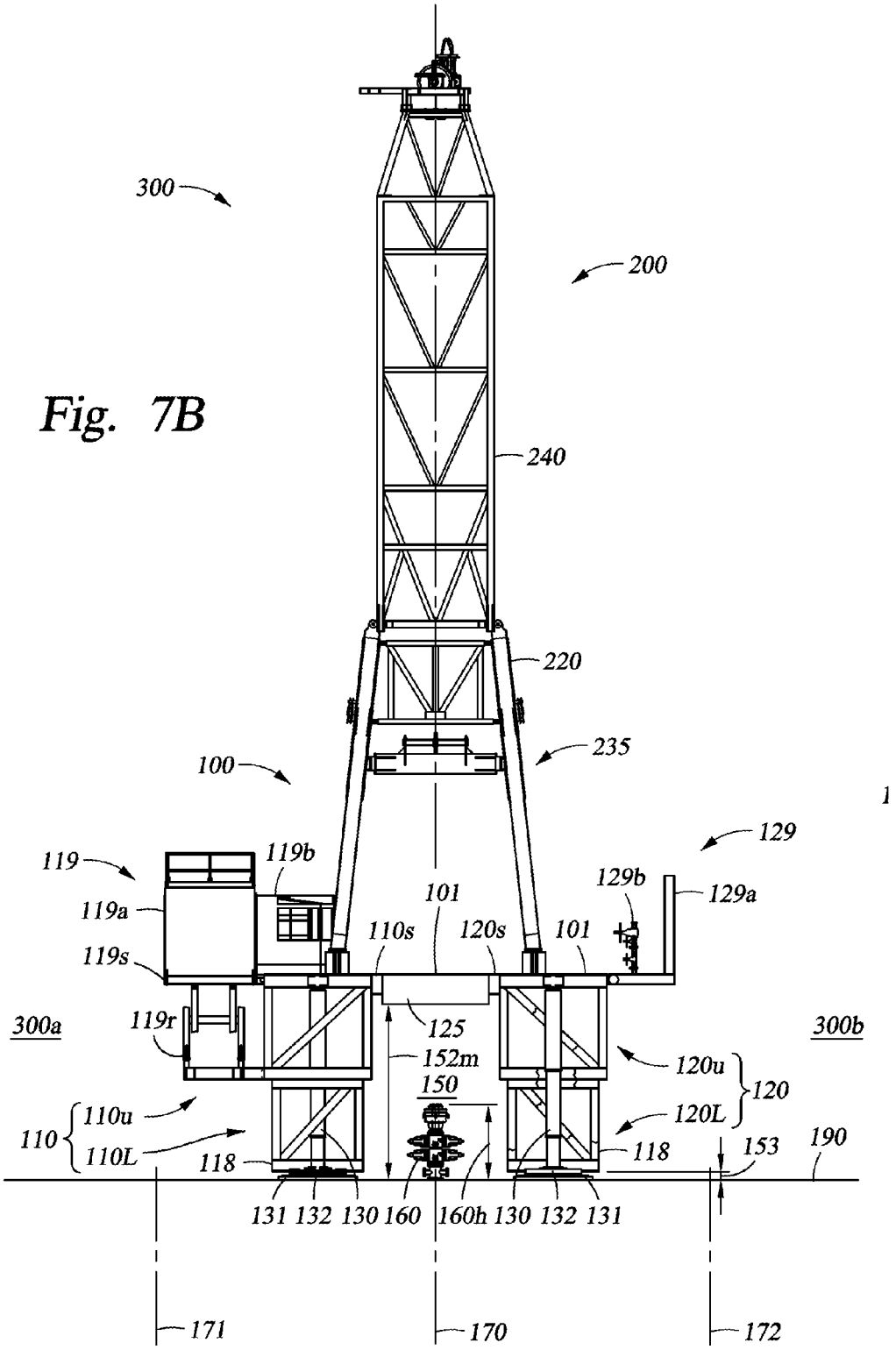

FIGS. 7A and 7B are side and end elevation views, respectively, of an exemplary mobile drilling rig 300 of the present disclosure, wherein, as noted above, the means for telescopically raising and lowering the substructure boxes 110 and 120 may also be used as means for lifting the mobile drilling rig 300 in preparation for skid movement of the rig 300 from a first wellbore location 170 to any adjacent wellbore location 171-174 during pad drilling operations. Accordingly, as with the previously described means for telescopically raising and lowering the telescoping substructure 100, the means for lifting the mobile drilling rig 300 may also sometimes be referred to herein as the "substructure raising apparatuses" 130 for simplicity. As shown in FIGS. 7A and 7B, the substructure raising apparatuses 130 may be adapted so that they are capable of lifting the fully assembled and erected mobile drilling rig 300 such that a clearance distance 153 is present between the bottom substructure boxes 110L, 120L and the ground 190 for skid movement of the drilling rig 300. In certain embodiments, the distance 153 may be on the order of 3-6 inches, although the distance 153 may vary from that range depending on the specific designs of the substructure raising apparatuses 130, the skid feet 131, and skid foot movement apparatuses 132.

As shown in the illustrative embodiment of FIG. 7A, when the mobile drilling rig 300 is raised by a distance 153 above the ground 190, a side-to-side open space between the base support boxes 118 that defines a skid side movement clearance 151*m* is present between each telescoping substructure box 110, 120 and the ground 190. In at least some illustrative embodiments, the skid side movement clearance 151*m* may be greater than a height 160*h* of any wellhead equipment 160 that may be positioned in the cellar area 150 of the telescoping substructure 100. In certain embodiments, the skid movement clearance side 151*m* may range from 8-13 feet or more, depending on the overall design of the telescoping substructure 100. Accordingly, in some embodiments, there may be sufficient skid side movement clearance 151*m* so that the substructure raising apparatuses 130 and the skid foot movement apparatuses 132 may be used to skid, or move, the mobile drilling rig 300 from above the wellbore location 170 in a lateral direction to either of the wellbore locations 171 or 172 (see, FIG. 7B), i.e., in the direction of the driller's side 300*a* or in the direction of the off-driller's side 300*b*, thus avoiding the use a heavy lift crane, or disassembling the rig 300.

Similarly, when the substructure raising apparatuses 130 are used as means for lifting the mobile drilling rig 300 by a distance 153 above the ground 190, an end-to-end open space between the telescoping substructure boxes 110 and 120 that defines a skid end movement clearance 152*m* may also be present between the substructure center floor section 125 and the ground 190, as shown in FIG. 7B. Furthermore, the skid end movement clearance 152*m* may range from approximately 18-28 feet or more, and in certain embodiments may also be greater than a height 160*h* of any wellhead equipment present in the cellar area 150 of the telescoping substructure 100. Accordingly, in such embodiments, the substructure raising apparatuses 130 and skid foot movement apparatuses 132 may also be used to skid the mobile drilling rig 300 from above the wellbore location 170 in a longitudinal direction to either of the wellbore locations 173 or 174 (see, FIG. 7A), i.e., in the direction of the drawworks side 300*c* or in the direction of the setback side 300*d*.

FIGS. 7C-7H close-up side elevation views showing the various sequential skid foot 131 movement steps that may be used to move the exemplary mobile drilling rig 300 of FIG. 7A in a longitudinal direction, i.e., in the direction of the setback side 300*d*, to the adjacent wellbore location 174. For ease of illustration and additional clarity, the upper mast section 240 of the mobile drilling rig 300 shown in FIG. 7A has not been included in FIGS. 7C-7H.

Figure 7C:
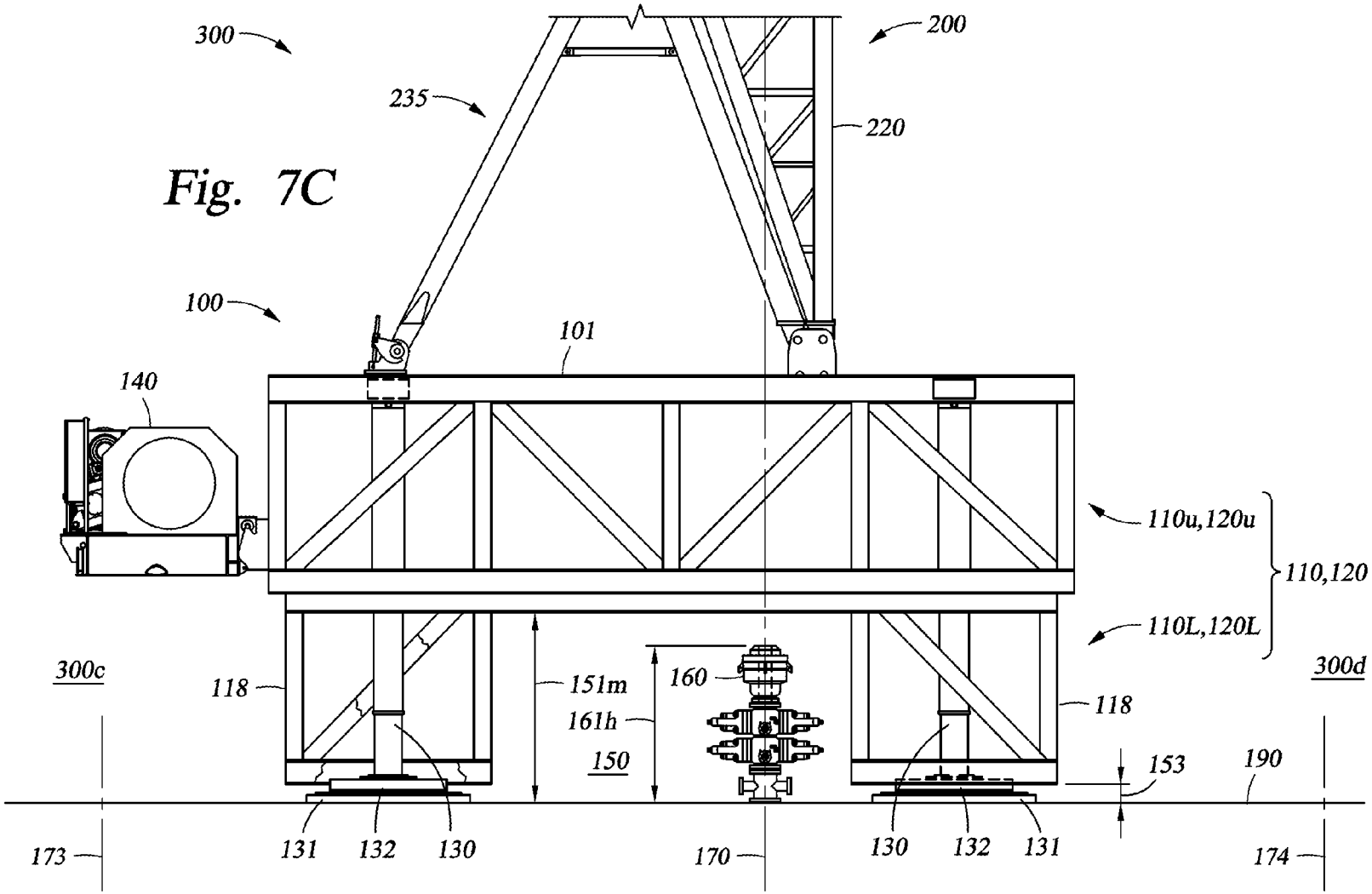
FIGS. 7C-7H are close-up side elevation views showing various sequential steps wherein the exemplary mobile drilling rig of FIG. 7A is moved to an adjacent wellbore location.
Figure 7D:
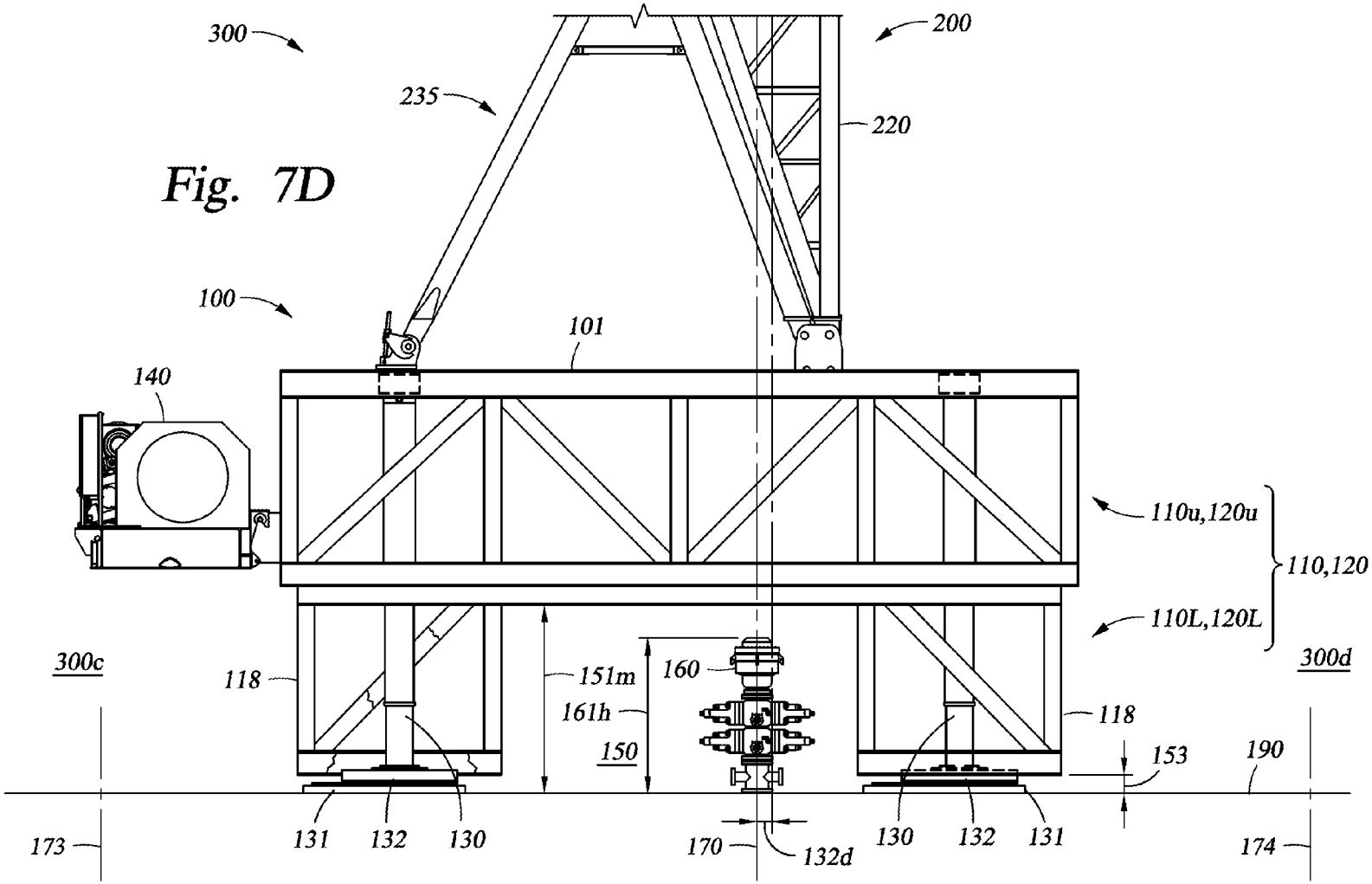

During a first skidding step of the skid movement operation, the mobile drilling rig 300 is first raised by a distance 153 above the ground 190 by actuating, i.e., extending, the substructure raising apparatuses 130, as illustrated in FIG. 7C. Thereafter, each skid foot movement apparatus 132 may then be actuated during a next skidding step so as to move the raised mobile drilling rig 300 in a longitudinal direction (and/or a lateral direction, if required) relative to each skid foot 131, which remain in bearing contact with the ground 190. Depending on the overall design of the skid foot movement apparatuses 132, the distance that the mobile drilling rig 300 may be moved during this step may be relatively short, e.g., approximately 12-24 inches, although the skid foot movement apparatuses 132 may be adapted to move the rig 300 by either shorter or longer distances. FIG. 7D illustrates the mobile drilling rig 300 after the skid foot movement apparatuses 132 have been actuated as described above and the rig 300 has been moved by a distance 132*d* away from the wellbore location 170 and toward the setback side 300*d* wellbore location 174.

In certain embodiments, the skid foot movement apparatuses 132 may include one or more powered movement apparatuses (not shown), such as hydraulic or pneumatic cylinders, and the like, which may be attached at one end to the lower end of a respective substructure raising apparatus 130, and attached at the other end to a respective skid foot 131. Accordingly, during the rig movement step described above, the powered movement apparatuses, e.g., hydraulic cylinders, of the skid foot movement apparatus 132 may be extended or retracted as required, thus moving the lower end of substructure raising apparatus 130—and the mobile drilling rig 300 attached thereto—relative to the skid foot 131, which, as noted, remains in contact with the ground 190.

Figure 7E:
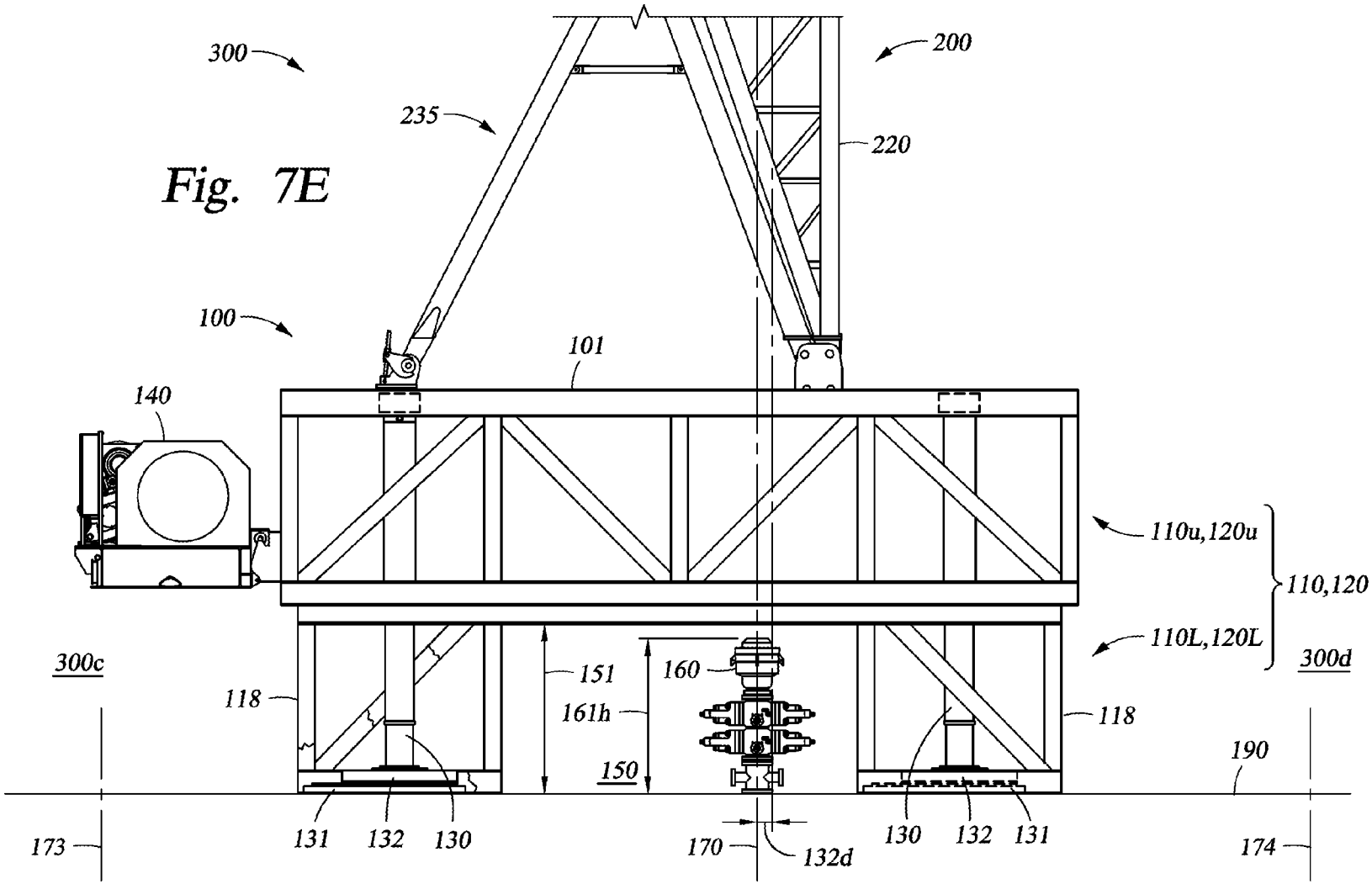
Figure 7F:
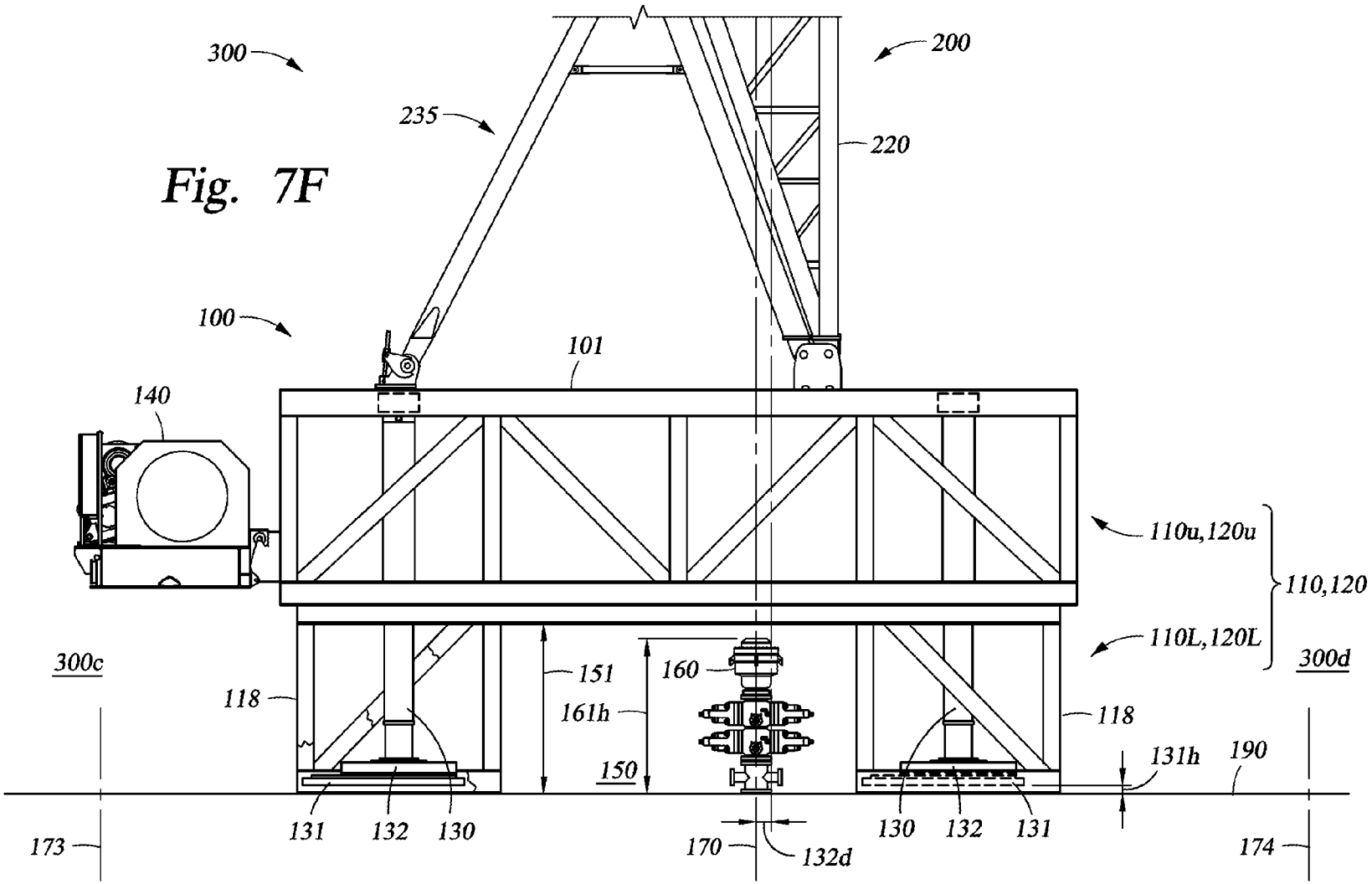

Next, the skid movement operation continues during a following skidding step wherein the substructure raising apparatuses 130 may be actuated, i.e., retracted, so as to lower the mobile drilling rig 300 until the base support boxes 118 of both lower substructure boxes 110L, 120L are again in bearing contact with the ground 190 as shown in FIG. 7E. Furthermore, actuation of the substructure raising apparatuses 130 may continue as shown in FIG. 7F so that each respective skid foot 131 may be raised a sufficient height 131*h* above the ground 190 to permit movement of the skid foot 131 by the skid foot movement apparatus 132 to a new "step" position toward the setback side 300*d* wellbore location 174, i.e., in a longitudinal direction. In certain embodiments, the height 131*h* may be relatively small, such as 3-6 inches and the like, however the height 131*h* may vary as required by the conditions of the ground 190, the length of the next "step" 132*s* (see, FIG. 7G) taken by the skid foot movement apparatuses 132, and the like.

Figure 7G:
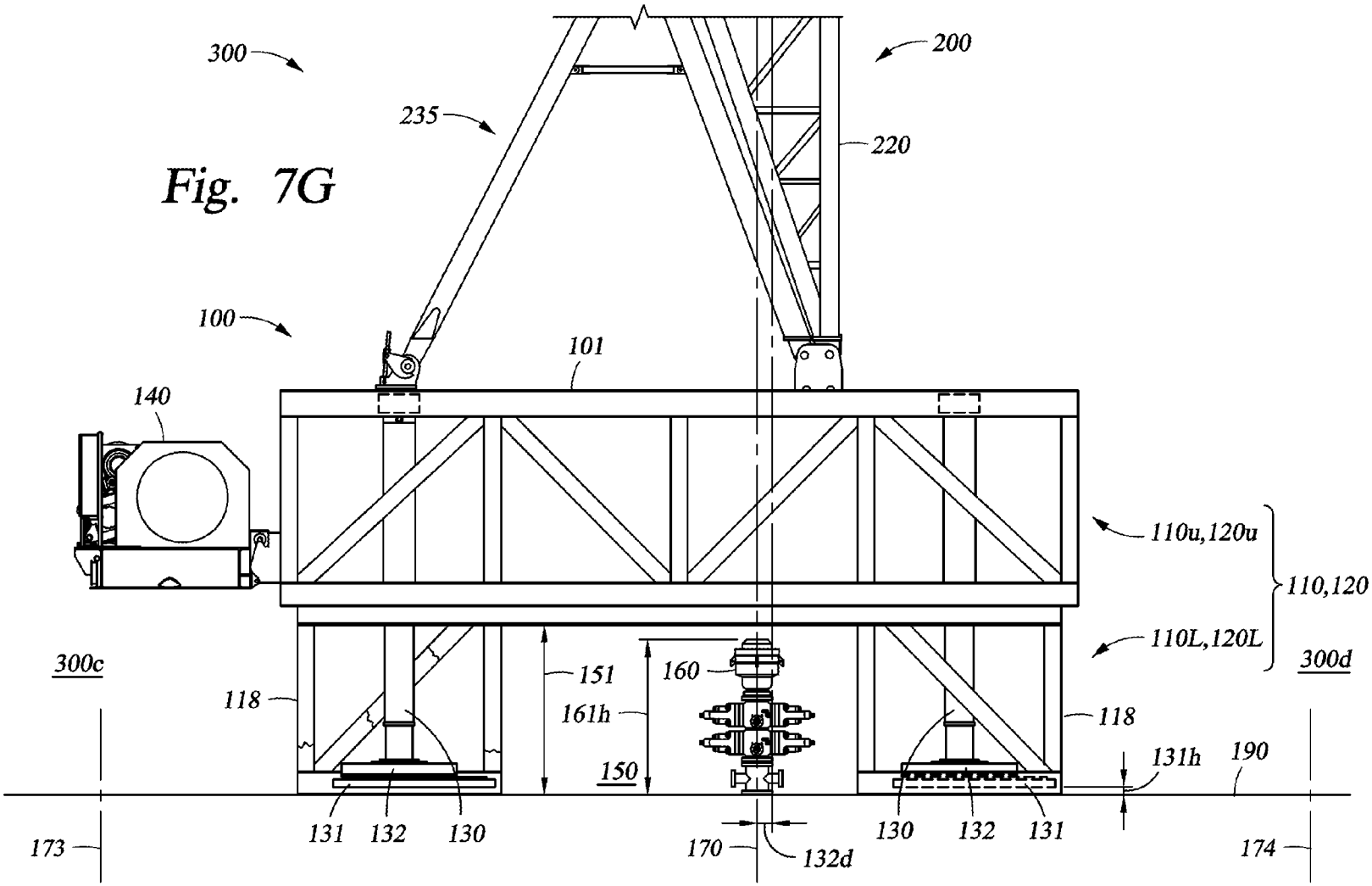
Figure 7H:
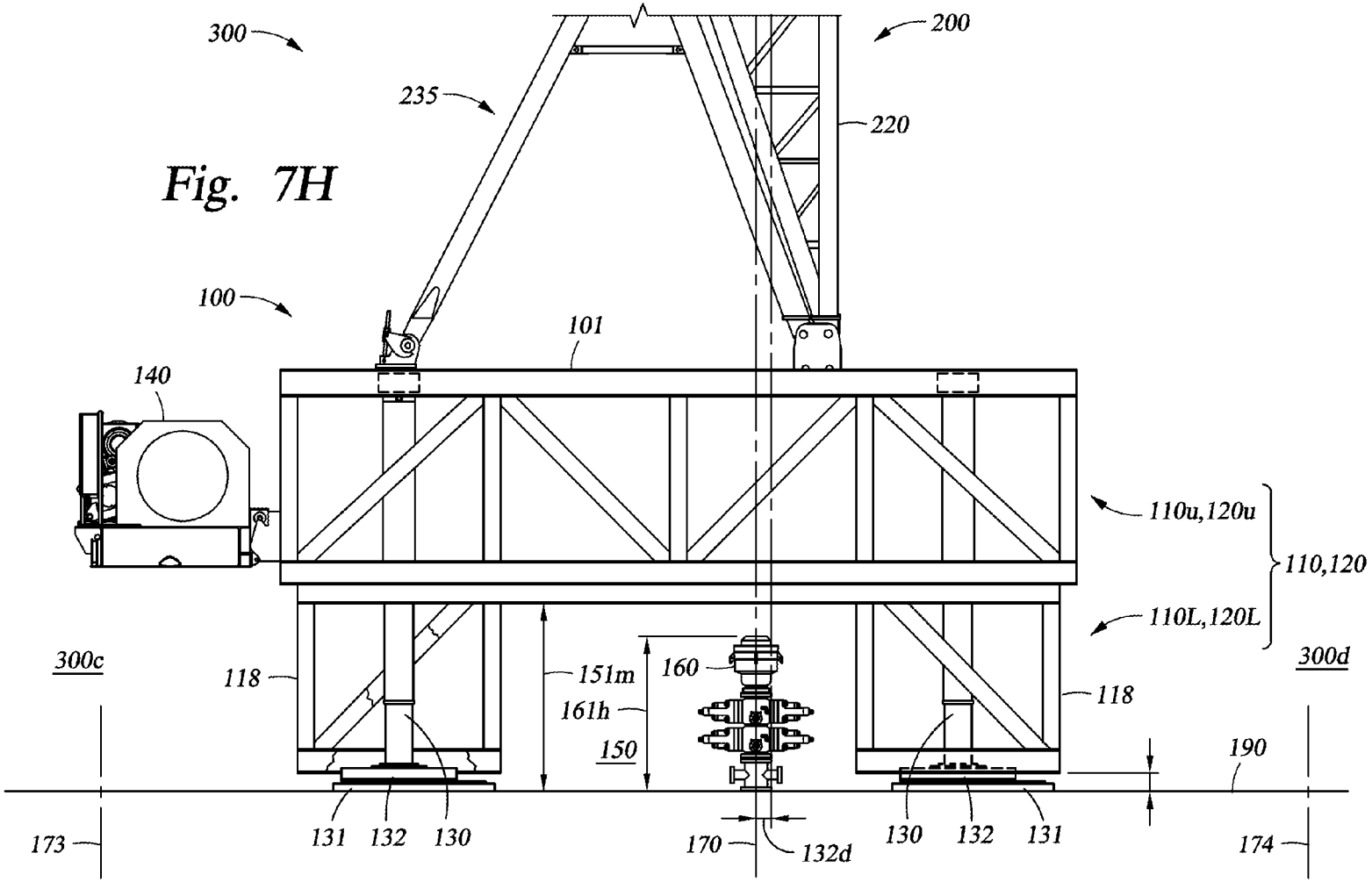

The skid movement operation then progresses to a next skidding step, wherein with each skid foot 131 raised above the ground 190 by a height 131*h*, each skid foot movement apparatus 132 may again be actuated so as to take a "step" 132*s* by moving a respective skid foot 131*a* short "step" distance, e.g., approximately 12-24 inches, relative to the lower end of the substructure raising apparatus, as shown in FIG. 7G. Thereafter, the substructure raising apparatuses 130 may again be actuated, i.e., extended, until each skid foot 131 contacts the ground 190 at the new "step" position, and the mobile drilling rig 300 is raised by a distance 153 above the ground 190 as shown in FIG. 7H, thus completing one "step."

The above sequence may then be repeated so that the mobile drilling rig 300 is moved during a plurality of "steps" 132*s* over short incremental "step" distances, e.g., 12-24 inches per "step," from the wellbore location 170 to the adjacent wellbore locations 174. In similar fashion, the mobile drilling rig 300 may be moved either laterally or longitudinally to any of the other wellbore locations 171-173, as may be required.

It should be appreciated by those of ordinary skill in the art after a complete reading of the present disclosure that the above-described skid movement operation may be readily adapted to move the mobile drilling rig 300 at substantially any angle relative to the lateral and/or longitudinal axes of the telescoping substructure 100. For example, in some applications, it may be desirable to skid the mobile drilling rig at, e.g., a 45° angle relative the longitudinal (or lateral) axis of the telescoping substructure 100. In such cases, each of the skid foot movement apparatuses 132 may be rotated substantially around a vertical axis of a respective substructure raising apparatus 130 at an angle of 45°, such that when each skid foot movement apparatus 132 is actuated to take a "step" as described above, each respective skid foot 131 may be moved at an angle of 45° to the longitudinal (or lateral) axis of the telescoping substructure 100. Using this general procedure, it should be understood that the skid foot movement apparatuses 132 may be rotated to substantially any required angle so that the mobile drilling rig 300 may be moved along substantially any desired angular path relative to the rig axes. Furthermore, it should also be appreciated that the entire mobile drilling rig 300 may be rotated around a vertical axis using a modified skid movement operation. For example, by orienting each alternating skid foot movement apparatus 132 at the same relative angle but in opposite directions, the "steps" taken by each skid foot movement apparatus 132 may be in different directions, but these differing directional "step" movements may be adapted to cooperate in such a fashion so as to rotate the rig 300 around a vertical axis.

As a result, the subject matter of the present disclosure provides details of various aspects of a telescoping substructure of a mobile drilling rig that can be collapsed for transportation over highways and/or roads to an oilfield drilling site, and which can also be telescoped, i.e., raised or lowered, as necessary to facilitate assembly of the mobile drilling rig without the use of traditional stand-alone cranes. Furthermore, in certain embodiments, the telescoping substructure of the present disclosure may be used in conjunction with a mast positioning apparatus during rig assembly to facilitate the positioning of a drilling rig mast above the drilling floor of the mobile drilling rig, and the proper alignment of the drilling rig mast connections with the mast support shoes on the telescoping substructure without the use of a crane. In other embodiments, substructure raising apparatuses and skid foot movement apparatuses on the telescoping substructure may be used to facilitate skid movement of the mobile drilling rig between adjacent wellbore locations during pad drilling operations, thereby avoiding the use of heavy lift cranes or disassembly of the rig.

The particular embodiments disclosed above are illustrative only, as the invention may be modified and practiced in different but equivalent manners apparent to those skilled in the art having the benefit of the teachings herein. For example, the method steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A telescoping substructure of a drilling rig, the telescoping substructure comprising:

first and second laterally spaced-apart telescoping substructure boxes, each comprising:

a lower substructure box;

an upper substructure box that is adapted to be telescopically raised and lowered relative to said lower substructure box, said upper substructure box comprising a plurality of structural members that are assembled to define a substantially open interior space and a substantially open bottom frame, wherein said substantially open interior space is sized to receive at least a portion of said lower substructure box through said substantially open bottom frame when said upper substructure box is telescopically raised and lowered relative to said lower substructure box; and raising means for telescopically raising and lowering said upper substructure box relative to said lower substructure box between a collapsed configuration for transportation and a raised configuration for drilling operations, wherein each of said first and second telescoping substructure boxes are adapted to facilitate a horizontal movement of said telescoping substructure across ground adjacent to a wellbore location in at least one of a lateral direction and a longitudinal direction over wellhead equipment positioned above said wellbore location while said upper substructure boxes are in said raised configuration, said lateral direction being substantially perpendicular to each of said first and second telescoping substructure boxes and said longitudinal direction being substantially parallel to each of said first and second telescoping substructure boxes.

2. The telescoping substructure of claim 1, wherein a portion of each of said lower substructure boxes is nested in said substantially open interior space of a respective one of said upper substructure boxes when said respective upper substructure box is telescopically raised and lowered relative to said respective lower substructure box.

3. The telescoping substructure of claim 2, wherein each of said lower substructure boxes comprises an upper frame, a first base support box attached to a first end of said upper frame, and a second base support box attached to a second end of said upper frame, an open space below said upper frame and between said first and second base support boxes defining a side clearance of said telescoping substructure when said upper substructure boxes are in said raised configuration, wherein said open space is sized to allow said wellhead equipment positioned above said wellbore location to pass through said open space during said horizontal movement of said telescoping substructure in at least said lateral direction.

4. The telescoping substructure of claim 3, wherein said at least said portion of each respective lower substructure box that is received by a respective substantially opening interior space of a respective upper substructure box through a respective substantially open bottom frame comprises at least a respective upper frame and a portion of respective first and second base support boxes.

5. The telescoping substructure of claim 1, further comprising moving means for moving said telescoping substructure in said at least one of said lateral and longitudinal directions.

6. The telescoping substructure of claim 5, wherein said raising means comprises a plurality of substructure raising apparatuses, and wherein said moving means comprises a skid foot and a skid foot movement apparatus operatively coupled to each of said plurality of substructure raising apparatuses, wherein each skid foot movement apparatuses is adapted to move a respective skid foot in a horizontal direction relative to a respective one of said plurality of substructure raising apparatuses to facilitate said horizontal movement of said telescoping substructure in said at least one of said lateral and longitudinal directions.

7. The telescoping substructure of claim 1, wherein said raising means comprises at least one hydraulic cylinder apparatus positioned adjacent to each end of said respective first and second telescoping substructure boxes.

8. The telescoping substructure of claim 1, further comprising a center floor section that is supported between said first and second telescoping substructure boxes, said telescoping substructure being adapted to support a drilling rig mast when said upper substructure boxes are telescopically raised and lowered.

9. A drilling rig mast erection system, comprising:

a mast support shoe fixedly attached to a drilling rig substructure, said mast support shoe comprising a first pinned connection;

a bottom mast section of a drilling rig mast, said bottom mast section comprising a second pinned connection that is adapted to be pivotably connected to said first pinned connection of said mast support shoe; and a mast positioning apparatus attached to said drilling rig substructure and pivotably attached to said bottom mast section, said mast positioning apparatus comprising a mast erection apparatus having a first end that is pivotably attached to said drilling rig substructure and a bottom mast support spreader having a first end that is pivotably attached to said bottom mast section, wherein said mast positioning apparatus is adapted to pivotably position said bottom mast section so that said second pinned connection of said bottom mast section is positioned adjacent to said first pinned connection of said mast support shoe, wherein said mast erection apparatus is adapted to be retracted so as to pivotably rotate said bottom mast support spreader, and wherein said pivotably rotating bottom mast support spreader is adapted to raise at least a lower end of said bottom mast section and pivotably position said second pinned connection of said bottom mast section adjacent to said first pinned connection of said mast support shoe.

10. The drilling rig mast erection system of claim 9, wherein a second end of said mast erection apparatus is pivotably attached to said bottom mast support spreader.

11. The drilling rig mast erection system of claim 10, wherein said second end of said mast erection apparatus is adapted to be pivotably attached to said bottom mast section after said second pinned connection of said bottom mast section has been pivotably connected to said first pinned connection of said mast support shoe and said mast erection apparatus is further adapted to be extended while said second end of said mast erection apparatus is pivotably attached to said bottom mast section so as to pivotably erect said drilling rig mast above said drilling rig substructure.

12. The drilling rig mast erection system of claim 9, wherein a second end of said bottom mast support spreader is adapted to be pivotably connected to a base support structure of said mast positioning apparatus, said base support structure being fixedly attached to said drilling rig substructure.

13. The drilling rig mast erection system of claim 9, wherein said mast erection apparatus is adapted to be actuated so as to move said second pinned connection of said bottom mast section from a position laterally adjacent to said drilling rig substructure to a position above said drilling rig substructure.

14. The telescoping substructure of claim 6, wherein each of said skid foot movement apparatuses comprises at least one hydraulic cylinder apparatus operatively coupled to said raising means and to said skid foot.

15. A telescoping substructure, comprising:

a first telescoping substructure box; and a second telescoping substructure box that is laterally spaced apart from said first telescoping substructure box, wherein each of said first and second telescoping substructure boxes comprises:

an upper substructure box comprising a plurality of structural members that are assembled to define a substantially open interior space and a substantially open bottom frame;

a lower substructure box, wherein at least a portion of said lower substructure box is sized to pass through said substantially open bottom frame of said upper substructure box and to nest inside of said substantially open interior space of said upper substructure box when said upper substructure box is telescopically raised and lowered relative to said lower substructure box; and raising means for telescopically raising and lowering said upper substructure box relative to said lower substructure box.

16. The telescoping substructure of claim 15, wherein said first and second telescoping substructure boxes are adapted to straddle a longitudinal centerline passing through a wellbore location positioned between said first and second telescoping substructure boxes, said telescoping substructure further comprising moving means for moving said telescoping substructure horizontally across ground adjacent to said wellbore location along said longitudinal centerline and over wellhead equipment positioned on said wellbore location while each of said upper substructure boxes are in a raised drilling configuration relative to said respective lower substructure boxes.

17. The telescoping substructure of claim 15, wherein said first and second telescoping substructure boxes are adapted to straddle a wellbore location positioned therebetween, each of said lower substructure boxes comprising an upper frame and first and second spaced-apart base support boxes that define an open space that is sized to allow wellhead equipment positioned above said wellbore location to pass through said open space during a horizontal movement of said telescoping substructure across ground adjacent to said wellbore location.

18. The telescoping substructure of claim 15, wherein each of said lower substructure boxes has a first outside length and a first outside width and said substantially open bottom frame of each of said upper substructure boxes has a second inside length that is greater than said first outside length and a second inside width that is greater than said first outside width.

19. A telescoping substructure box, comprising:

a lower substructure box that is adapted to support said telescoping substructure box, said lower substructure box comprising a plurality of lower structural members that are assembled to define at least an upper frame; and an upper substructure box that is adapted to be raised and lowered relative to said lower substructure box between a raised drilling position and a lowered transportation position, said upper substructure box comprising a plurality of upper structural members that are assembled to define a substantially open interior space and a substantially open bottom frame, wherein said substantially open interior space of said upper substructure box is sized to receive said upper frame of said lower substructure box through said substantially open bottom frame of said upper substructure box when said upper substructure box is telescopically raised and lowered relative to said lower substructure box.

20. The telescoping substructure box of claim 19, further comprising raising means for telescopically raising and lowering said upper substructure box relative to said lower substructure box.

21. The telescoping substructure box of claim 19, wherein said lower structural members of said lower substructure box are assembled to define a base support box and said substantially open interior space of said upper substructure box is sized to receive a portion of said base support box of said lower substructure box through said substantially open bottom frame of said upper substructure box when said upper substructure box is telescopically raised and lowered relative to said lower substructure box.

22. A telescoping substructure, comprising:

a first telescoping substructure box; and a second telescoping substructure box that is laterally spaced apart from said first telescoping substructure box, wherein each of said first and second telescoping substructure boxes comprise:

a lower substructure box comprising a plurality of structural members that are assembled to define a substantially open interior space and a substantially open upper frame;

an upper substructure box, wherein at least a portion of said upper substructure box is sized to pass through said substantially open upper frame of said lower substructure box and to nest inside of said substantially open interior space of said lower substructure box when said upper substructure box is telescopically raised and lowered relative to said lower substructure box; and raising means for telescopically raising and lowering said upper substructure box relative to said lower substructure box.

23. The telescoping substructure of claim 22, wherein said first and second telescoping substructure boxes are adapted to straddle a longitudinal centerline passing through a wellbore location positioned between said first and second telescoping substructure boxes, said telescoping substructure further comprising moving means for moving said telescoping substructure horizontally across ground adjacent to said wellbore location along said longitudinal centerline and over wellhead equipment positioned on said wellbore location while each of said upper substructure boxes are in a raised drilling configuration relative to said respective lower substructure boxes.

24. A telescoping substructure box, comprising:

an upper substructure box comprising a plurality of upper structural members;

a lower substructure box comprising a plurality of lower structural members that are assembled to define a substantially open interior space and a substantially open upper frame, wherein said substantially open interior space of said lower substructure box is sized to receive at least a portion of said upper substructure box through said substantially open upper frame of said lower substructure box when said upper substructure box is telescopically raised and lowered relative to said lower substructure box between a raised drilling position and a lowered transportation position; and raising means for telescopically raising and lowering said upper substructure box relative to said lower substructure box.

25. The telescoping substructure box of claim 24, wherein said lower structural members of said lower substructure box are assembled to define a first base support box attached to a first end of said upper frame, and a second base support box attached to a second end of said upper frame, an open space below said upper frame and between said first and second base support boxes defining a side clearance of said telescoping substructure box when said upper substructure box is in said raised drilling position, wherein said open space is sized to allow wellhead equipment positioned above a wellbore location adjacent to said telescoping substructure box to pass through said open space during a horizontal movement of said telescoping substructure box across ground adjacent to said wellbore location.

* * * * *